US011377771B2

(12) United States Patent
Kim et al.

(10) Patent No.: US 11,377,771 B2
(45) Date of Patent: Jul. 5, 2022

(54) WASHING MACHINE AND CONTROL METHOD OF THE SAME

(71) Applicant: LG Electronics Inc., Seoul (KR)

(72) Inventors: Jinho Kim, Seoul (KR); Bongjae Kim, Seoul (KR); Jaehyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 112 days.

(21) Appl. No.: 16/586,466

(22) Filed: Sep. 27, 2019

(65) Prior Publication Data

US 2020/0102682 A1 Apr. 2, 2020

(30) Foreign Application Priority Data

Sep. 28, 2018 (KR) ..... 10-2018-0116365

(51) Int. Cl.

| | |
|---|---|
| ***D06F 37/20*** | (2006.01) |
| ***D06F 33/48*** | (2020.01) |
| ***D06F 37/30*** | (2020.01) |
| *D06F 105/48* | (2020.01) |

(52) U.S. Cl.

CPC ..... *D06F 33/48* (2020.02); *D06F 37/304* (2013.01); *D06F 2105/48* (2020.02)

(58) Field of Classification Search

CPC ..... D06F 37/203

See application file for complete search history.

(56) References Cited

FOREIGN PATENT DOCUMENTS

| | | |
|---|---|---|
| EP | 2719806 | 4/2014 |
| EP | 3378982 | 9/2018 |
| KR | 2015-0140961 | 12/2015 |
| WO | 2017/009048 | 1/2017 |

OTHER PUBLICATIONS

Extended European Search Report in European Appln. No. 19200150.1, dated Jan. 1, 2020, 10 pages.

*Primary Examiner* — Jason Y Ko

(74) *Attorney, Agent, or Firm* — Eish & Richardson

(57) ABSTRACT

A washing machine includes: a tub; a transmission coil provided in the tub and transmitting power wirelessly; an ammeter measuring an input current value of the transmission coil; a cylindrical drum disposed inside the tub and configured to rotate; a balancer for reducing unbalance during rotation of the drum; and a controller controlling the ammeter and the balancer. The balancer includes: a reception coil provided in the drum and configured to generate power from magnetic field formed by the transmission coil; drive modules driven by power of the reception coil and provided in the drum; and at least one balancing weight that moves along a circumference of the drum by a driving force of each drive module, and changes a center of gravity of the drum. The controller determines a position of the balancing weights based on the input current value when the drum rotates.

12 Claims, 21 Drawing Sheets

WASHING MACHINE AND CONTROL METHOD OF THE SAME

CROSS-REFERENCE TO RELATED APPLICATION

This application claims the priority benefit of Korean Patent Application No. 10-2018-0116365, filed on Sep. 28, 2018, the disclosure of which is incorporated herein by reference.

BACKGROUND OF THE INVENTION

1. Field of the Invention

The present invention relates to a washing machine for determining the position of a balancer that is actively movable, and a control method of the washing machine.

2. Description of the Related Art

In general, a washing machine is an apparatus that performs cleaning through a process such as washing, rinsing, dehydrating, and the like to remove contamination on clothes, bedding, etc. (hereinafter, referred to as 'cloth') by using water, detergent, and mechanical action.

Washing machines are classified into agitator type, pulsator type, and drum type washing machines.

The agitator type washing machine performs washing by rotating a laundry rod towering in the center of the washing tub from side to side, the pulsator type washing machine rotates a disk-shaped rotary blades formed in the lower portion of the washing tub from side to side to perform washing by using frictional force between the water flow and the cloth, and the drum type washing machine performs washing by putting water, detergent, and cloth into the drum, and rotating the drum.

The drum washing machine is provided with a tub, a drum, a motor, and a drive shaft. The tub, in which washing water is accommodated, is provided inside a cabinet forming an outer shape. The drum, which accommodates a cloth, is disposed inside the tub. The motor is mounted in the rear surface side of the tub so as to rotate the drum. The drive shaft which penetrates through the motor and is connected to the rear surface side of is built up in the drum. The inside of the drum is equipped with a lifter to lift the cloth when the drum rotates.

Such a washing machine has a phenomenon in which the cloth is biased to one side due to the entanglement of the cloth, which causes an eccentricity in which one side becomes heavy based on the center of the drum. When the cloth is eccentric and the drum rotates at high speed (e.g., when the cloth is dehydrated), vibration and noise are generated by unbalance where the geometric center of the drum's rotation axis itself and the actual center of gravity are not coincident. An apparatus, which is called a balancer, for reducing the unbalance of the drum is installed in order to reduce such vibration and noise.

A counter weight for counterbalancing eccentricity by attaching additional mass has been used as a balancer for drum type washing machines. Recently, as shown in Korean Utility Model Publication No. 1998-019360, a ball balancer that has a ring-shaped space, which is formed in the front surface or rear surface of the drum, having a certain width in the circumferential direction, inserts a ball therein, and then, fills liquid to completely seal by heat-welding is mainly employed. When the drum rotates at high speed, the balancer distributes the inner material to move away from the center of gravity of the cloth so that the center of gravity of the drum approaches the center of rotation.

Such a ball balancer scheme has a problem in that it cannot correctly resolve the unbalance actively.

In addition, there is a problem in that, in order to actively move the balancer to solve the unbalance, the eccentricity must be detected or the position of the balancer must be accurately detected while the eccentricity is solved.

A position sensor of the balancer has errors and failures that frequently occur, and if a large number of position sensors are not used, accurate detection is difficult. Accordingly, there is a problem of increasing unbalance in the balancing of the washing machine operation.

SUMMARY OF THE INVENTION

The present invention has been made in view of the above problems, and provides a washing machine which actively moves to actively eliminate the unbalance, and a control method of the washing machine.

The present invention further provides a balancer and a washing machine which can operate by wireless power, have a simple structure, and can reduce the number of parts.

The present invention further provides a balancer and a washing machine which are stably fixed at the time of heat-welding of a guide case while a reception coil does not interfere with a moving balancing weight.

The present invention further provides a washing machine which can determine the position of the balancing weight moving along the circumference of the drum without a separate sensor, and a control method of the washing machine.

In order to achieve the above object, the present invention determines the position of the balancing weights based on the input current value of the transmission coil when the drum rotates.

In detail, the washing machine of the present invention includes: a tub for accommodating washing water; a transmission coil which is provided in the tub and transmits power wirelessly by generating a wireless power signal; an ammeter which measures an input current value of the transmission coil; a cylindrical drum which is disposed inside the tub to accommodate cloth and is rotatable; a balancer for reducing unbalance generated by a biasing of the cloth during rotation of the drum; and a controller for controlling the ammeter and the balancer, wherein the balancer includes; a reception coil which is provided in the drum and generates power from a magnetic field formed by the transmission coil; at least two drive modules which are driven by the power of the reception coil and provided in the drum; and at least one balancing weight which moves along a circumference of the drum by a driving force of each drive module, and changes a center of gravity of the drum, wherein the controller determines a position of the balancing weights based on the input current value when the drum rotates.

The controller controls the ammeter to measure an input current value for each unit time during at least one rotation of the drum, and determines a first time point at which the input current value is equal to or less than a preset first current value as a position of the reception coil.

The controller detects a second time point at which the input current value is equal to or greater than a preset second current value, and determines a phase difference between the reception coil and the balancing weight based on a time difference between the first time point and the second time point.

The controller controls the ammeter to measure the input current value for each unit time during at least one rotation of the drum, and determines a third time point at which the input current value becomes equal to or greater than a preset third current value as a position of the reception coil.

The controller detects a second time point at which the input current value is equal to or greater than a preset second current value and is less than or equal to the third current value, and determines a phase difference between the reception coil and the balancing weight based on a time difference between the third time point and the second time point.

The controller determines a minimum point of the input current value, on an input current curve showing a change in the input current value over time during at least one rotation of the drum, as a position of the reception coil, and determines a band section in which the input current value is equal to or greater than a preset reference current value as the position of the balancing weight.

The controller determines as a position of the drive module, when a width of the band section is smaller than a preset width.

The controller determines a phase difference between the reception coil and the balancing weight based on a time difference between the minimum point of the input current value and a peak of the band section.

The controller determines a maximum point of the input current value, on an input current curve showing a change in the input current value over time during at least one rotation of the drum, as a position of the reception coil, and determines a band section in which the input current value becomes a value between a preset reference current value and a preset second current value, as a position of the balancing weight.

The controller determines as a position of the drive module, when a width of the band section is smaller than a preset width.

The controller determines a phase difference between the reception coil and the balancing weight based on a time difference between the maximum point of the input current value and a peak of the band section.

The method of controlling a washing machine of the present invention includes the steps of: (a) supplying power to a transmission coil; (b) rotating a drum at least once; (C) measuring a change in an input current value of the transmission coil for each unit time during one rotation of the drum; and (d) determining a position of a balancing weight based on the input current value.

The step (d) includes determining a minimum point of the input current value as a position of a reception coil.

The step (d) includes determining a band section in which the input current value is equal to or greater than a preset reference current value as a position of a balancing weight.

The step (d) includes determining a phase difference between the reception coil and the balancing weight based on a time difference between the minimum point of the input current value and a peak of the band section.

The step (d) includes determining a maximum point of the input current value as a position of a reception coil.

The step (d) includes determining a band section in which the input current value becomes a value between a preset reference current value and a preset second current value, as the position of the balancing weight.

The step (d) includes determining a phase difference between the reception coil and the balancing weight based on a time difference between the maximum point of the input current value and a peak of the band section.

BRIEF DESCRIPTION OF THE DRAWINGS

The above and other objects, features and advantages of the present invention will be more apparent from the following detailed description in conjunction with the accompanying drawings, in which.

DETAILED DESCRIPTION OF THE PREFERRED EMBODIMENTS

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention. As used herein, the singular form is intended to include the plural forms as well, unless the context clearly indicates otherwise. In the present application, it will be further understood that the terms "comprises", includes," etc. specify the presence of stated features, integers, steps, operations, elements, components, or combinations thereof, but do not preclude the presence or addition of one or more other features, integers, steps, operations, elements, components, or combinations thereof. Unless defined otherwise, the terms including technical and scientific terms used in this specification may have the meaning that can be commonly apprehended by those skilled in the art. The terms, such as the terms defined in the commonly-used dictionary, must be interpreted based on the context of the related technology and must not be interpreted ideally or excessively.

Hereinafter, preferred embodiments of the present invention will be described with reference to the accompanying drawings.

Figure 1A:
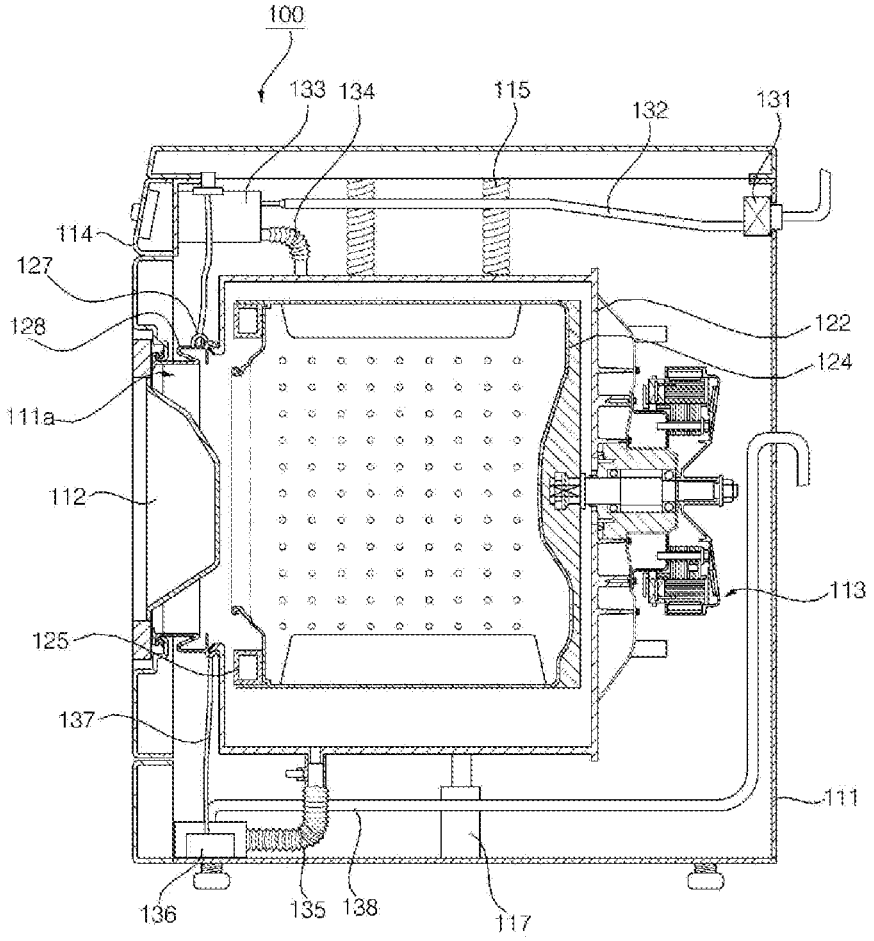
FIG. 1A is a cross-sectional view of a washing machine according to an embodiment of the present invention.
Figure 1B:
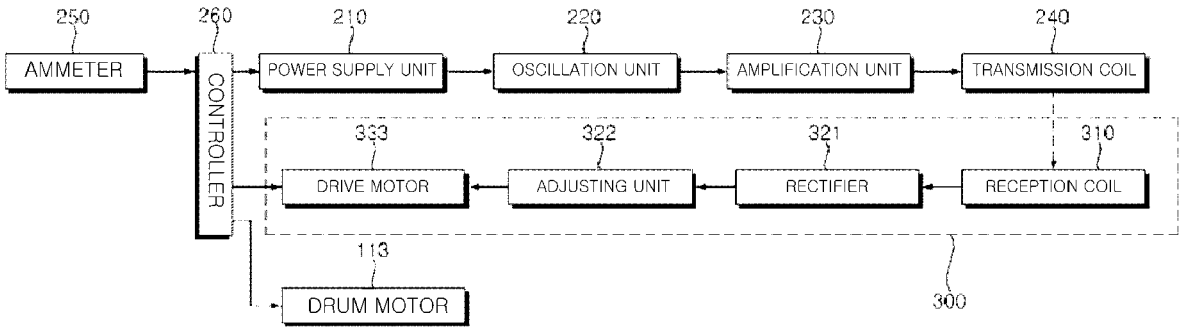
FIG. 1B is a block diagram of the washing machine shown in FIG. 1A.
Figure 2:
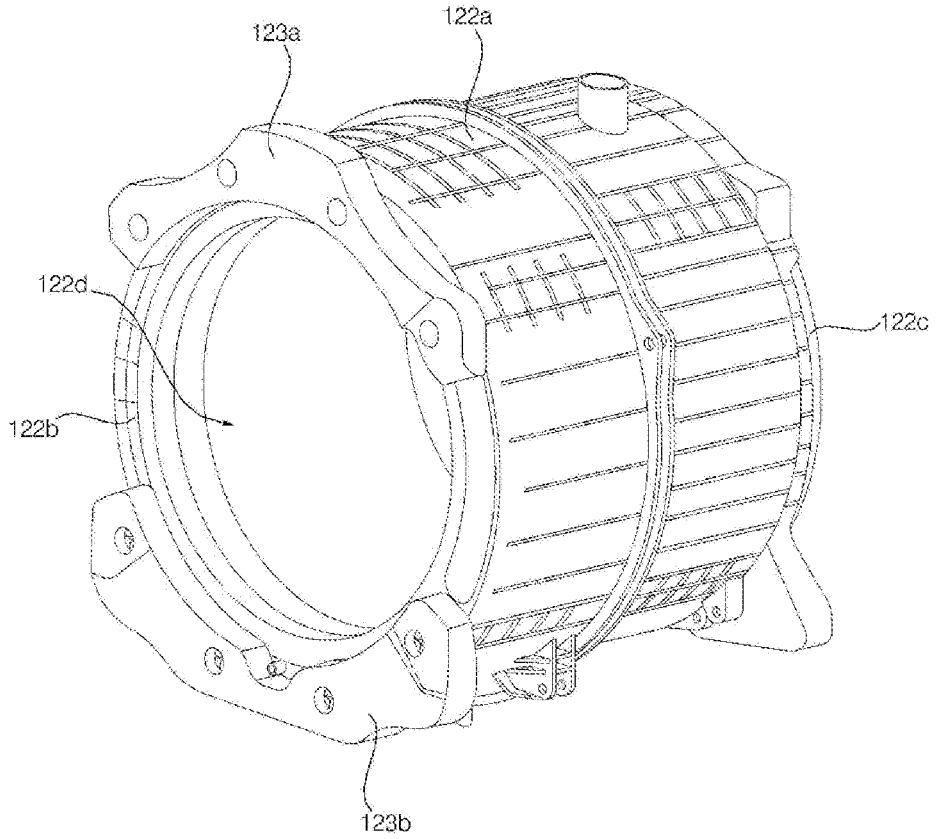
FIG. 2 is a perspective view of a tub of the washing machine shown in FIGS. 1A and 1B.
Figure 3:
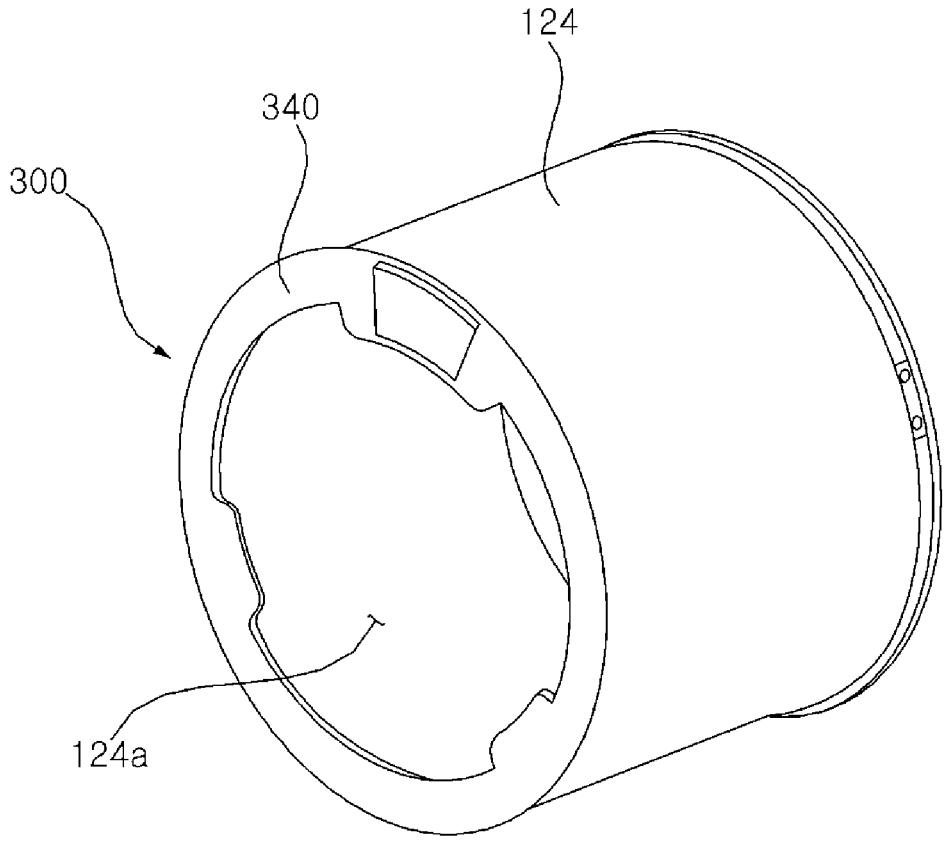
FIG. 3 is a perspective view of a drum of the washing machine shown in FIGS. 1A and 1B and a balancer installed in the drum.

FIG. 1A is a cross-sectional view of a washing machine according to an embodiment of the present invention, FIG. 1B is a block diagram of the washing machine shown in FIG. 1A, FIG. 2 is a perspective view of a tub of the washing machine shown in FIGS. 1A and 1B, and FIG. 3 is a perspective view of a drum of the washing machine shown in FIGS. 1A and 1B and a balancer installed in the drum.

A washing machine 100 according to an embodiment of the present invention includes a cabinet 111 which forms an outer shape, a door 112 which opens and closes one side of the cabinet to allow the cloth to enter and exit the cabinet, a tub 122 disposed inside the cabinet and supported by the cabinet, a drum 124 disposed inside the tub and rotating with a cloth inserted therein, a drum motor 113 which rotates the drum by applying torque to the drum, a detergent box 133 which accommodates detergent, and a control panel 114 which receives a user input and displays a washing machine state.

The cabinet 111 has a cloth loading hole 111*a* formed to allow the cloth to enter and exit. The door 112 is rotatably coupled to the cabinet 111 to allow the cloth loading hole 111*a* to be opened and closed. The cabinet 111 is provided with the control panel 114. The cabinet 111 is provided with a detergent box 133 to be withdrawn.

The tub 122 is disposed in the cabinet 111 to be buffered by a spring 115 and a damper 117. The tub 122 accommodates washing water. The tub 122 is disposed in the outside of the drum 124 while surrounding the drum 124.

The tub 122 includes a cylindrical tub body 122*a* having both sides opened, a ring-shaped front tub cover 122*b* disposed in an opened front side of the tub body 122*a*, and a disk-shaped rear tub cover 122*c* disposed in an opened rear side of the tub body 122*a*. Hereinafter, the front side means the door 112 side, and the rear side means the drum motor 113 side.

A tub hole 122*d* is formed in one side of the tub 122. The tub hole 122*d* is formed to communicate with the cloth loading hole 111*a* to allow the cloth to enter and exit the drum 124. The tub hole 122*d* is formed in the front tub cover 122*b*.

A weight 123 is coupled to a portion of one side edge of the tub 122. The weight 123 applies a load to the tub 122. The weight 123 is preferably disposed around the tub hole 122*d*. A plurality of weights 123 may be provided, and disposed in a portion of upper side and lower side of the front tub cover 122*b*.

The plurality of weights 123 includes an upper weight 123*a* disposed above the front tub cover 122*b* and a lower weight 123*b* disposed below the front tub cover 122*b*. The upper weight 123*a* is disposed above the tub hole 122*d* among the edge of the tub 122, and the lower weight 123*b* is disposed below the tub hole 122*d* among the edge of the tub 122.

A transmission coil 240 described later may be disposed in the edge of one side of the tub 122. The transmission coil 240 wirelessly supplies power to the balancer 300.

The drum motor 113 generates a rotational force. The drum motor 113 may rotate the drum 124 at various speeds or directions. The drum motor 113 includes a stator (not shown) wound around with a coil, and a rotor (not shown) that rotates by generating electromagnetic interaction with the coil.

The drum 124 accommodates the cloth and is rotated. The drum 124 is disposed inside the tub 122. The drum 124 is formed in a rotatable cylindrical shape. The drum 124 is provided with a plurality of through holes so that the washing water can pass. The drum 124 rotates while receiving the rotational force of the drum motor 113.

A drum hole 124*a* is formed in the front side of the drum 124. The drum hole 124*a* is formed to communicate with the cloth loading hole 111*a* and the tub hole 122*d* so that the cloth can be loaded into the drum 124.

The balancer is coupled to the edge of one side of the drum 124. The balancer reduces the unbalance generated by the biasing of the cloth when the drum rotates.

A gasket 128 seals between the tub 122 and the cabinet 111. The gasket 128 is disposed between the opening of the tub 122 and the cloth loading hole 111*a*. The gasket 128 mitigates the shock transmitted to the door 112 when the drum 124 rotates, while preventing the washing water in the tub 122 from leaking to the outside. The gasket 128 may be provided with a circulation nozzle 127 for introducing washing water into the drum 124.

The detergent box 133 accommodates a detergent such as laundry detergent, fabric softener or bleach. The detergent box 133 is preferably provided in the front surface of the cabinet 111 to be withdrawn. The detergent in the detergent box 133 is mixed with the washing water when the washing water is supplied, and introduced into the tub 122.

It is preferable that a water supply valve 131 for controlling the inflow of the washing water from an external water source, a water supply flow path 132 through which the washing water introduced into the water supply valve flows into the detergent box 133, and a water supply pipe 134 for introducing washing water mixed with detergent in the detergent box 133 into the tub 122 are provided inside the cabinet 111.

It is preferable that a drain pipe 135 through which the washing water in the tub 122 is discharged, a pump 136 for discharging the washing water in the tub, a circulation flow path 137 for circulating the washing water, a circulation nozzle 127 for introducing the washing water into the drum 124, and a drain flow path 138 for draining the washing water to the outside are provided inside the cabinet 111. According to an embodiment, the pump 136 may be provided with a circulation pump and a drain pump, and may be connected to the circulation flow path 137 and the drain flow path 138, respectively.

The balancer 300 is provided in the front side and/or rear side of the drum 124 and, in the present embodiment, is coupled to the edge of the front side of the drum 124. The balancer 300 is preferably disposed around the drum hole 124*a*.

The balancer 300 moves along the edge of the drum 124 and changes the center of gravity of the drum 124. In this case, the center of gravity of the drum 124 does not mean the center of gravity of the drum 124 itself, but means a common center of gravity of objects including the drum 124, the cloth accommodated in the drum 124, the balancer 300, and components attached to the drum 124 that rotate together with the drum 124 when the drum 124 rotates.

The balancer 300 moves along the circumferential direction of the drum 124 to adjust the center of gravity of the drum 124 when the cloth is eccentric. When the drum 124 rotates while the cloth is eccentric, vibration and noise are generated due to unbalance in which the geometric center of a rotation axis Ax itself and the actual center of gravity of the drum 124 are not coincident. The balancer 300 reduces the unbalance of the drum 124 by allowing the center of gravity of the drum 124 to approach the rotation axis Ax.

The control panel 114 may include an input unit (not shown) for receiving various operation commands such as a washing course selection, an operation time and reservation for each process through a user, and a display unit (not shown) for displaying the operation state of the washing machine 100.

Referring to FIG. 1B, the washing machine according to an embodiment of the present invention includes a power supply unit 210 for supplying electric power from the outside, an oscillation unit 220 for generating a voltage fluctuation range in the power supplied from the power supply unit 210, an amplification unit 230 for amplifying the power, a transmission coil 240 for generating a magnetic field, a reception coil 310 for generating power due to electromagnetic induction from a magnetic field, a rectifier 321 for converting a power generated in the reception coil 310 into a direct power, an adjusting unit 322 for adjusting the power into a certain voltage and current, a drive motor 333 for generating power, and a current measuring device for measuring an input current value of the transmission coil 240.

In addition, the washing machine may further include a controller for controlling the overall operation of the washing machine, such as the operations of the drive motor 333, the power supply unit 210, and the drum motor 113.

The power supply unit 210 converts commercial power, which is AC supplied from the outside, into an appropriate power. In the present embodiment, the power supply unit is a switched-mode power supply to convert the commercial power into 14V DC. The power supply unit 210 may be provided in a certain position inside the cabinet 111 or in the control panel 114. The power converted and supplied by the power supply unit 210 may also be supplied to the drum motor 113.

The oscillation unit 220 is an oscillator, and generates a voltage fluctuation range in the power supplied from the power supply unit 210 to generate a magnetic field in the transmission coil 240. The amplifier 230 amplifies the power so that the transmission coil 240 can acquire a sufficient current.

The transmission coil 240 generates a magnetic field, and the reception coil 310 generates power due to electromagnetic induction from the magnetic field in which the transmission coil 240 is generated.

The current measuring device measures the input current value of the transmission coil 240 to provide to the controller. A general ammeter may be used as the current measuring device.

The rectifier 321 converts the power generated from the reception coil 310 into DC power. The adjusting unit 322 adjusts the power rectified by the rectifier 321 into a certain voltage and current.

The drive motor 333 generates power from the power adjusted by the adjusting unit 322. The drive motor 333 generate power from the power that is supplied from the outside and transmitted wirelessly through the transmission coil 240 and the reception coil 310. Generally, the adjusting unit 322 and the rectifier 321 are disposed in a circuit board 370 described later.

According to an embodiment, a storage unit (not shown) for temporarily storing the power adjusted by the adjusting unit 322 may be provided, and the storage unit (not shown) may be configured of a capacitor or a battery.

The above-mentioned oscillation unit 220 and amplifier 230 are preferably provided in a certain position inside the cabinet 111 or in the control panel 114, and the reception coil 310, the rectifier 321, the adjusting unit 322, and the drive motor 333 are preferably included in the balancer 300.

The transmission coil 240 is disposed in the edge of one side of the tub 122 as described above.

The transmission coil 240 is disposed in the tub 122 to correspond to the movement path of the balancer 300 and wirelessly supplies power to the balancer 300. The transmission coil 240 may be disposed in the tub 122 in correspondence with a guide case 340 described later.

The transmission coil 240 may be formed in an arc shape and disposed in a portion of one side edge of the tub 122, or may be formed in a ring shape and disposed in the entire of one side edge of the tub 122. The transmission coil 240 is preferably disposed around the tub hole 122*d* which is an edge of the front side of the tub 122.

The transmission coil 240 may be disposed in the front tub cover 122*b* or the rear tub cover 122*c*. In the present embodiment, the transmission coil 240 is disposed in the front tub cover 122*b*. The transmission coil 240 is preferably disposed in the front side of the front tub cover 122*b* to face a guide rail 125.

The tub 122 is preferably coupled to a coil cover (not shown) surrounding the transmission coil 240. The coil cover (not shown) is coupled to the front tub cover 122*b* to surround the transmission coil 240. The coil cover (not shown) protects the transmission coil 240 from water or foreign matter together with the front tub cover 122*b*.

The transmission coil 240 is preferably disposed in the front tub cover 122*b* in correspondence with the balancer 300. The reception coil 310 is provided in one side of the balancer 300 and the transmission coil 240 is disposed to correspond to the reception coil 310. The transmission coil 240 is disposed in a portion of the moving path of the reception coil 310 to allow the magnetic field generated in the transmission coil 240 to be converted into power in the reception coil 310.

It is preferable that the distance between the transmission coil 240 and the reception coil 310 maintains a distance in which power can be transmitted wirelessly. The distance between the transmission coil 240 and the reception coil 310 is preferably within 30 mm.

When a plurality of balancers 300 are provided, a plurality of transmission coils 240 may be provided.

Referring to FIG. 2, the weight 123 is coupled to a portion of the edge of the drum 124. The transmission coil 240 is preferably disposed in an area where the weight 123 is not disposed among the edge of one side of the tub 122. At this time, the transmission coil 240 is preferably formed in an arc shape.

A plurality of weights 123 are provided and disposed in a portion of the upper and lower sides of the front tub cover 122*b*. A plurality of transmission coils 240 are provided in both sides of the front tub cover 122*b* between the upper weight 123*a* and the lower weight 123*b*.

Hereinafter, referring to FIGS. 4 to 8, the balancer 300 will be described in detail.

Figure 4:
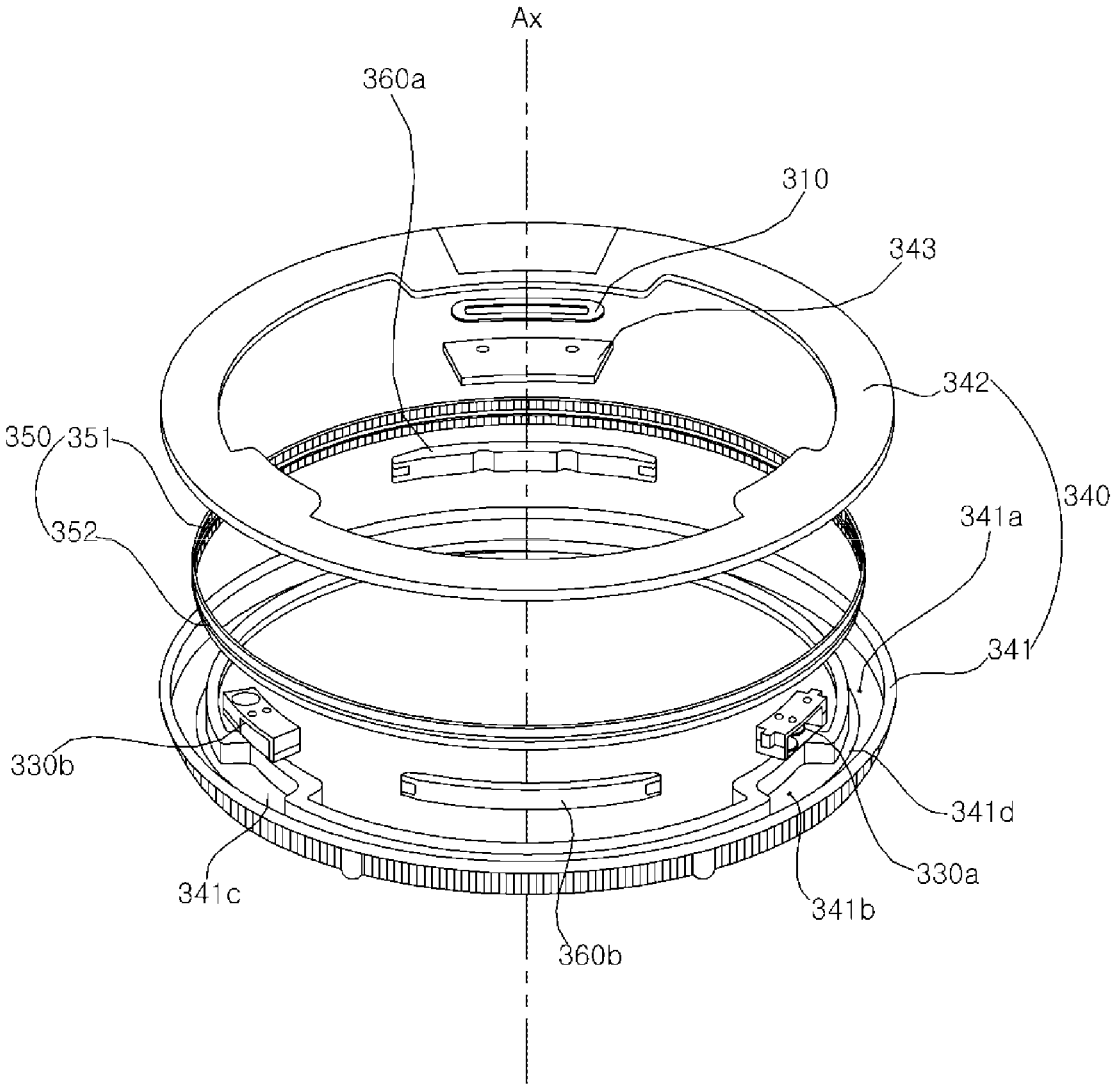
FIG. 4 is an exploded perspective view of a balancer according to an embodiment of the present invention.

The balancer 300 may further include at least two drive modules 330 which provide driving force, at least two gear rails 350 which are formed in a ring shape and rotated while being gear-coupled with each drive module 330, at least two balancing weights 360 which move along the circumference of the drum 124 by rotation of each gear rail 350 to change the center of gravity of the drum 124, the reception coil 310 which generates power from a magnetic field formed by the transmission coil, a guide case 340 for receiving at least reception coil 310 and drive module 330, and a coil base which supports the reception coil Referring to FIGS. 4 and 5, the guide case 340 accommodates at least reception coil 310 and drive module 330. Preferably, the guide case 340 may accommodate the circuit board 370 described later, the balancing weight 360, and the gear rail 350. The guide case 340 may be provided in the front side and/or rear side of the drum 124, and in the present embodiment, the guide case 340 is provided in the front side of the drum 124. When the drum 124 is rotated, the cloth accommodated in the drum 124 is generally collected in the inner side of the drum 124, i.e., in the rear side. Accordingly, it is preferable that the guide case 340 is provided in the front side of the drum 124 so as to be balanced to the cloth collected in the rear side of the drum 124.

According to the present invention, the drive module 330 and the circuit board 370 are not integrally formed with the balancing weight 360, but separately fixed to the guide case 340, so that the drive module 330 and the circuit board 370 do not move when the balancing weight 360 is moved, thereby reducing damage occurred during movement.

The guide case 340 has a ring shape corresponding to the circumference of the drum 124, and may have a space in which the balancing weight 360 moves along the circumference of the drum 124, a space for accommodating the drive module 330 and the reception coil 310, and a space for accommodating the gear rail 350.

In detail, the guide case 340 may include a case body 341 and a case cover 342 covering the case body 341.

The case body 341 is provided with a guide part 341*a* which is a passage through which the balancing weight 360 passes. The guide part 341*a* is formed by recessing a cross section of the case body 341 downward so that the balancing weight 360 is movable therein. The guide part 341*a* may have a ring shape corresponding to the circumference of the drum 124 so as to guide a path along which the balancing weight 360 moves.

The guide case 340 may further include a drive module accommodating part 341*b* and 341*c* extended from the guide part 341*a* in the direction of the rotation axis Ax of the drum 124 to accommodate each drive module 330. The drive module accommodating part 341*b* and 341*c* may be formed by recessing a portion of the case body 341 in the downward direction. In detail, the drive module accommodating part 341*b* and 341*c* may be defined as a recessed area communicating with the guide part 341*a*.

The guide case 340 may further include a receiver accommodating part 341*f* extended from the guide part 341*a* in the direction of the rotation axis Ax of the drum 124 to place the reception coil 310. The receiver accommodating part 341*f* may be formed by recessing a portion of the case body 341 in a downward direction (see FIG. 4). In detail, the receiver accommodating part 341*f* may be defined as a recessed area communicating with the guide part 341*a*.

Obviously, the reception coil 310 may be accommodated directly in the receiver accommodating part 341*f*, or the coil base may be installed in the receiver accommodating part 341*f*, and the reception coil 310 may be installed in the coil base 343. The coil base 343 will be described later.

The guide case 340 may have a support part 341*g* for supporting the coil base 343 around the guide part 341*a*. The support part 341*g* may support the coil base 343 and define a gap 21 that is a spaced space between the coil base 343 and the guide case 340. The support part 341*g* may be formed in a part of the edge of the guide part 341*a*, and in the edge of the receiver accommodating part 341*f*.

Figure 5A:
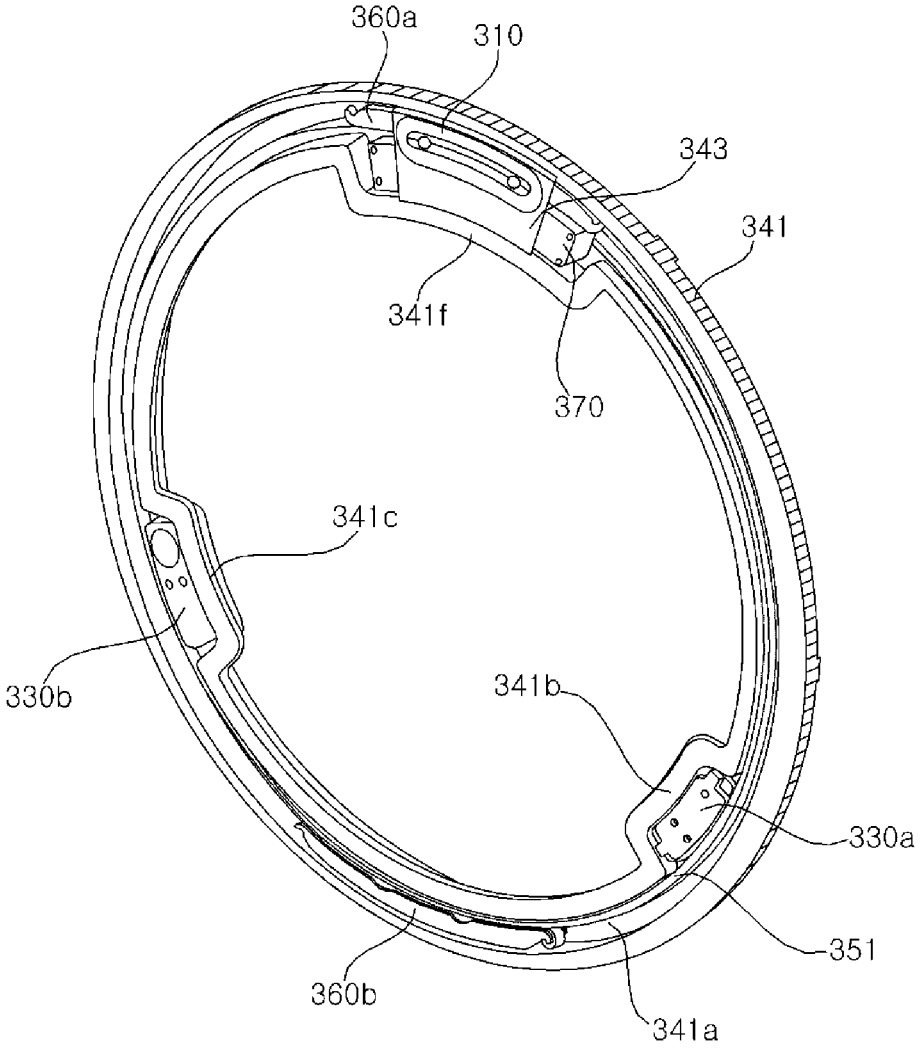
FIG. 5A is a perspective view of a balancer according to an embodiment of the present invention.
Figure 5B:
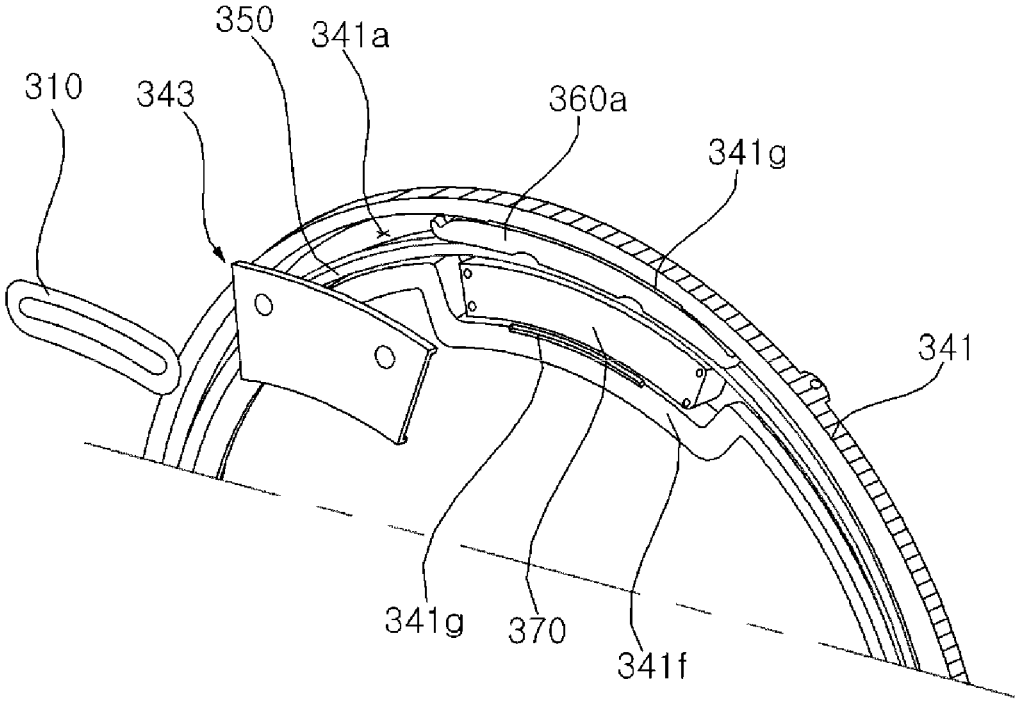
FIG. 5B is a partially exploded perspective view of a balancer according to an embodiment of the present invention.
Figure 5C:
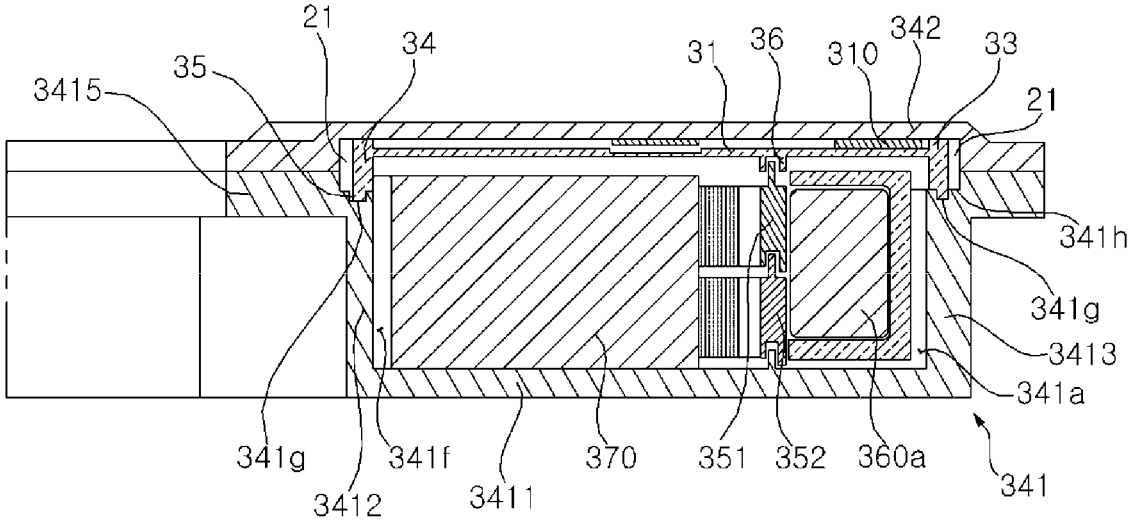
FIG. 5C is a cross-sectional view of a balancer according to an embodiment of the present invention.
Figure 5D:
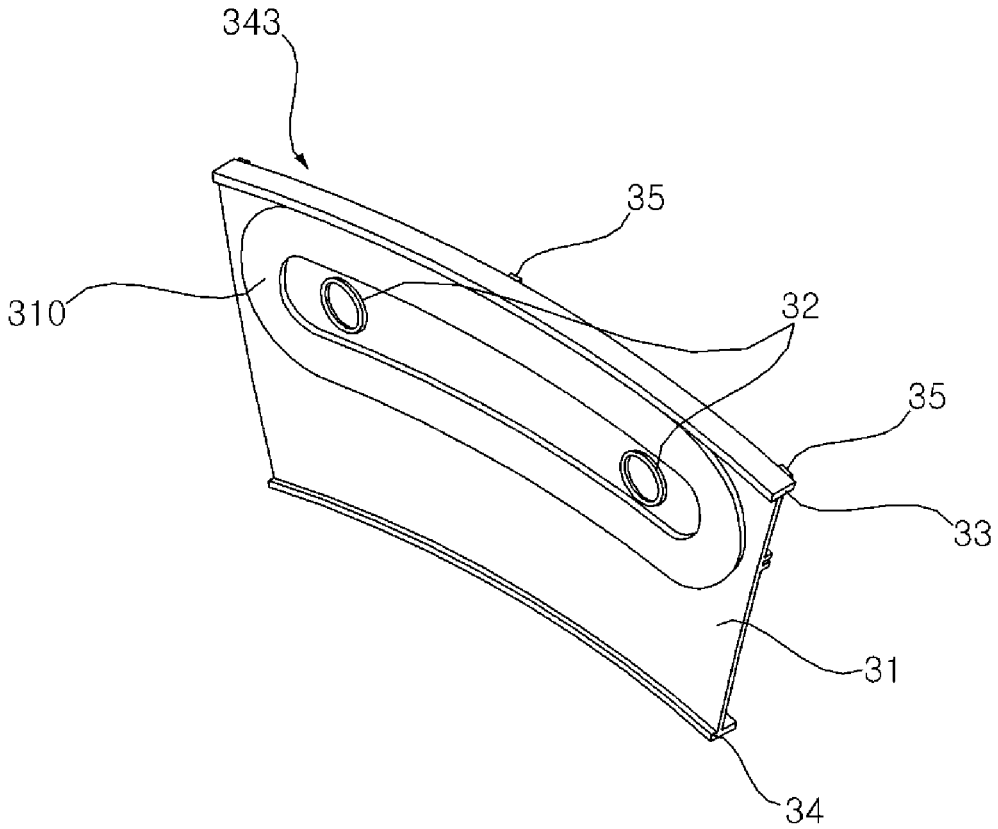
FIG. 5D is a perspective view of a coil base from one direction according to an embodiment of the present invention.
Figure 5E:
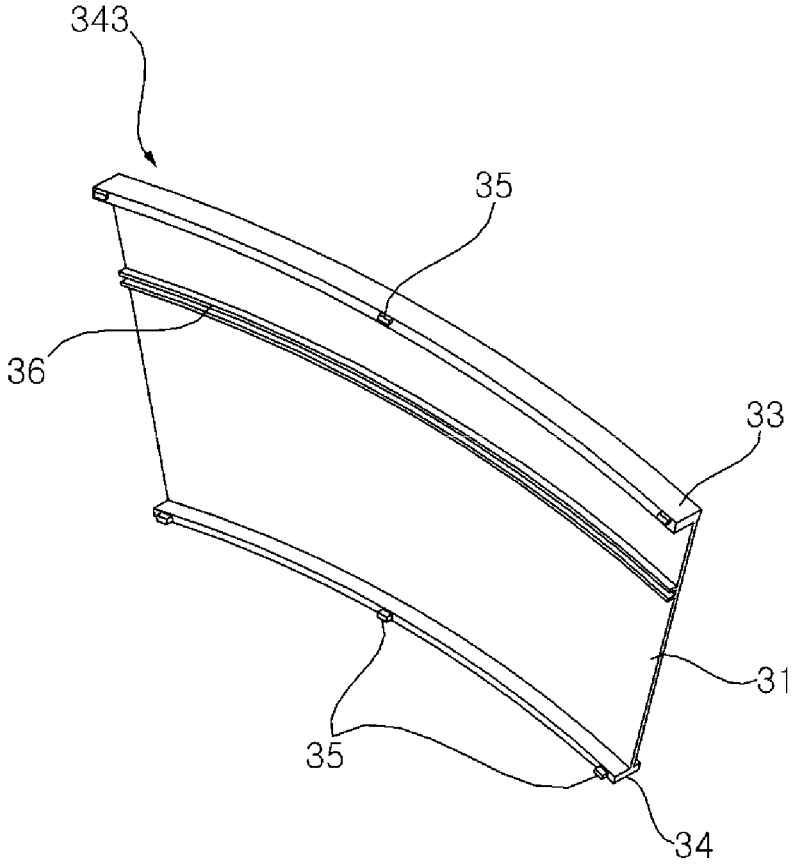
FIG. 5E is a perspective view of a coil base from another direction according to an embodiment of the present invention.

In detail, referring to FIG. 5C, the case body 341 may include a bottom surface 3411, a flange 3415 positioned above the bottom surface 3411, and an inner surface 3412 and an outer surface 3413 connecting the flange 3415 and bottom face 3411. The bottom surface 3411, the inner surface 3412 and the outer surface 3413 together define the receiver portion accommodating portion 341*f* and the guide part 341*a*. That is, the bottom surface 3411 forms the bottom surface of the receiver accommodating part 341*f* and the guide part 341*a*, and the inner surface 3412 and the outer surface 3413 form a side surface of the receiver accommodating part 341*f* and the guide part 341*a*.

The flange 3415 extended in a direction away from both ends of the bottom surface 3411 at the upper end of each of the inner surface 3412 and the outer surface 3413, thereby providing the case cover 342 and an adhesive surface. The flange 3415 is heat-welded with the case cover 342. The flange 3415, the inner surface 3412, the outer surface 3413, and the bottom surface 3411 are extended along the circumference respectively.

The support part 341*g* may be formed in a portion of the inner surface 3412 and the outer surface 3413 of the case body 341. Alternatively, the support part 341*g* may be formed in the flange 3415. Here, the inner surface 3412 of the case body 341 means a surface closer to the rotation axis Ax of the drum than the outer surface 3413.

The support part 341*g* may be a groove formed by recessing the inner surface 3412 and the outer surface 3413 in a downward direction. Obviously, the support portion 341*g* may be defined as a groove communicating with the guide part 341*a* and/or the receiver accommodating part 341*f*. An alignment groove 341*h* to which a fixing protrusion 35 of the coil base 343 is coupled may be formed in the support part 341*g*.

The guide case 340 may further include a rail accommodating part 341*d* extended from the guide part 341*a* in the direction of the rotation axis Ax of the drum 124 to place the reception coil 310. The rail accommodating part 341*d* may be formed by recessing a portion of the case body 341 in the downward direction. In detail, the rail accommodating part 341*d* may be defined as a recessed area communicating with the guide part 341*a*.

The rail accommodating part 341*d* is positioned inside the guide part 341*a*, and the drive module accommodating part 341*b* and 341*c* and the receiver accommodating part 341*f* are positioned spaced apart from each other inside the rail accommodating part 341*d*.

The balancer 300 may further include a circuit board 370 which transmits power of the reception coil 310 to the drive modules 330, and generates a control signal for controlling the drive module 330.

According to the present invention, the manufacturing cost can be reduced by controlling the two drive modules 330 with a single circuit board 370, and the circuit board 370 does not move together with the balancing weight 360, thereby improving reliability. The circuit board 370 is accommodated in the guide case 340. In detail, it is accommodated in the receiver accommodating portion 341*f* of the guide case 340.

At least a portion of the circuit board 370 and the reception coil 310 may be disposed to be overlapped with each other when viewed in the rotation axis Ax direction of the drum 124. This is because the power generated by the reception coil 310 is transmitted to the circuit board 370 in the shortest distance, thereby reducing the manufacturing cost.

The drive module 330 provides a driving force. The number of drive modules 330 corresponds to the number of balancing weights 360. In detail, the drive module 330 may include a first drive module 330*a* and a second drive module 330*b*.

Each drive module 330 may include a drive motor 333, a pinion gear 332 engaged with the drive motor 333, and each gear rail 350, and a motor housing accommodating the drive motor 333 and the pinion gear 332.

The drive motor 333 generates a driving force from the power which is supplied from the outside and is transmitted wirelessly through the transmission coil 240 and the reception coil 310. Preferably, the drive motor 333 is a motor that generates a rotational force. The drive motor 333 rotates the pinion gear 332. When the drive motor 333 is a motor, a worm gear is disposed between the motor and the pinion gear 332 so that the rotational force changes the axis of the motor to rotate the pinion gear 332.

The pinion gear 332 is rotated by receiving power from the drive motor 333. A rack gear 351*b* is disposed in the inner circumferential surface of the gear rail 350, and the pinion gear 332 meshes with the rack gears 351*b*, 125*a*.

The pinion gear 332 rotates by meshing with the rack gears 351*b*, 125*a* to rotate the gear rail 350, and when the gear rail 350 rotates, the balancing weight 360 restrained by the gear rail 350 is moved.

The pinion gear 332 is engaged with the rack gear 351*b*, 125*a* to prevent the balancing weight 360 from moving by its own weight or by centrifugal force when the drum 124 rotates.

The motor housing 331 accommodates the pinion gear and the drive motor 333, and is fixed to the guide case 340. The motor housing 331 is fixed to the drive module accommodating part 341*b*, 341*c*.

When the reception coil 310 and the first and second drive modules 330 are biased toward one side of the guide case 340, the unbalance of the drum 124 may occur. Accordingly, is preferable that the reception coil 310 and the first and second drive modules 330 are disposed in consideration of the balance of the center of gravity of the drum 124.

For example, the reception coil 310 and the first and second drive modules 330 are spaced apart from each other on an arbitrary circumference around the rotation axis Ax of the drum 124, the separation distance between the reception coil 310 and the first drive module 330*a* is the same as the separation distance between the reception coil 310 and the second drive module 330*b*, and the separation distance between the first drive module 330*a* and the second drive module 330*b* may be the same as the separation distance between the reception coil 310 and the first drive module 330*a*.

For another example, the center angle between the reception coil 310 and the first drive module 330*a* may be the same as the center angle between the reception coil 310 and the second drive module 330*b*. The center angle between the first drive module 330*a* and the second drive module 330*b* may be the same as the center angle between the reception coil 310 and the first drive module 330*a*.

Here, the center angle between the reception coil 310 and the first drive module 330*a* may be referred to as a first center angle θ1, the center angle between the reception coil 310 and the second drive module 330*b* may be referred to as a second center angle θ2, and the center angle between the first drive module 330*a* and the second drive module 330*b* may be referred to as a third center angle θ3.

Figure 6:
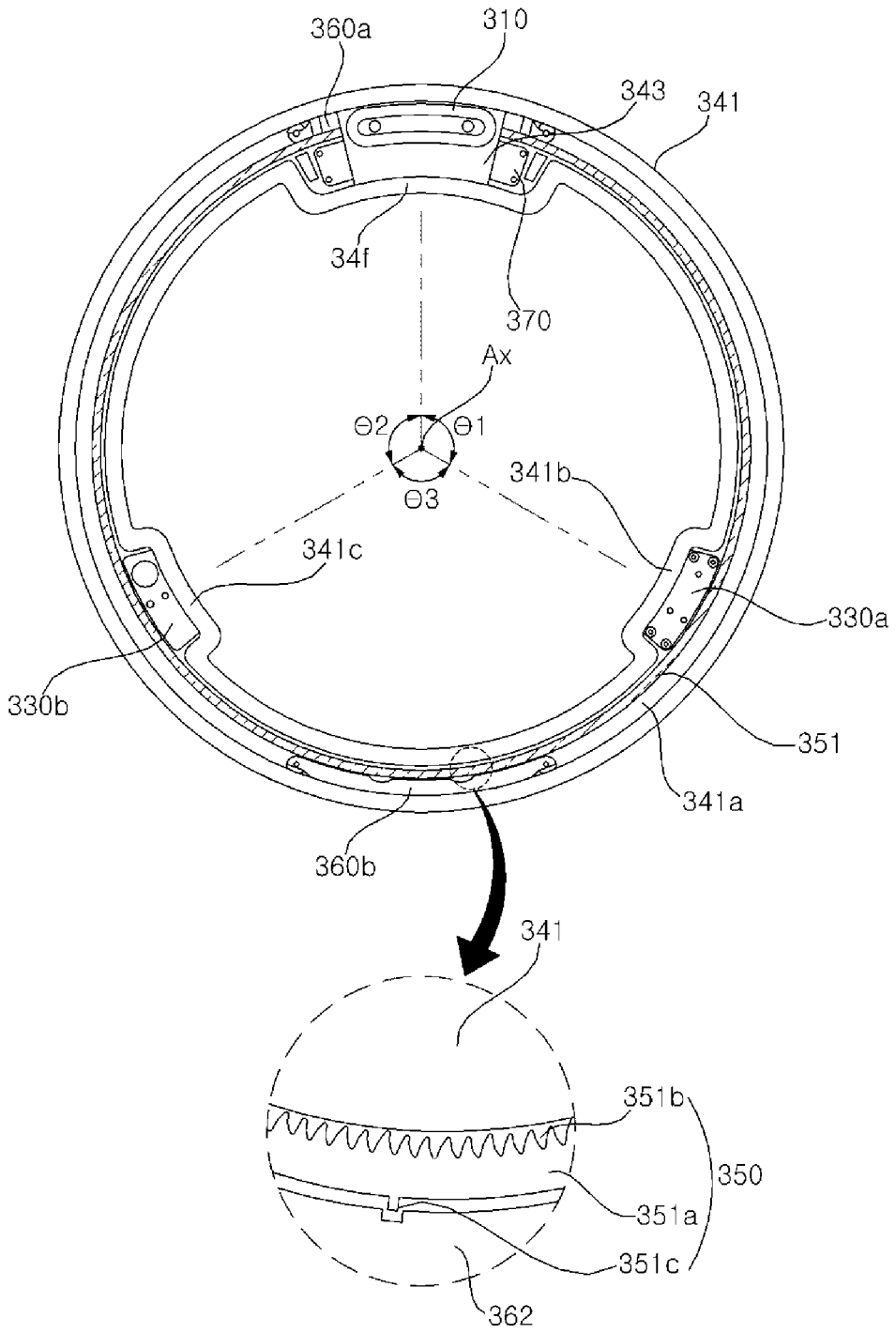
FIG. 6 is a plan view of a balancer according to an embodiment of the present invention.
Figure 7:
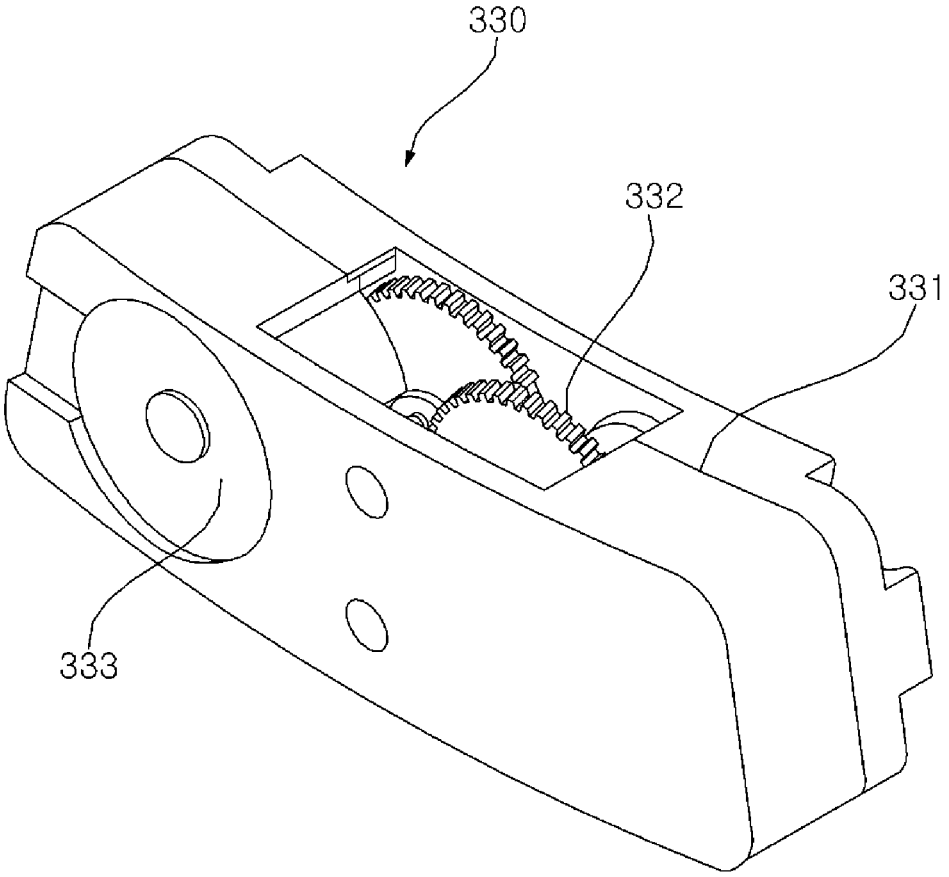
FIG. 7 is a perspective view of a drive module according to an embodiment of the present invention.
Figure 8:
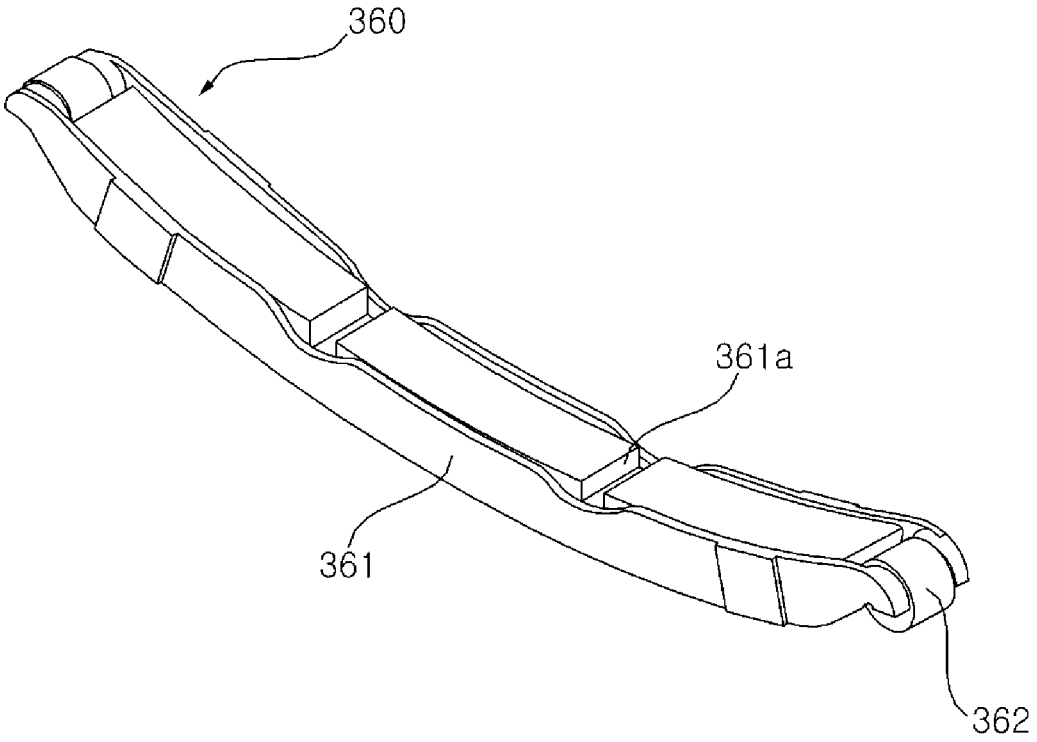
FIG. 8 is a perspective view of a balancing weight according to an embodiment of the present invention.

As shown in FIG. 6, the first center angle means the angle between a line connecting the center of the reception coil 310 and the rotation axis Ax of the drum 124, and a line connecting the center of the first drive module 330*a* and the rotation axis Ax of the drum 124, the second center angle means the angle between a line connecting the center of the reception coil 310 and the rotation axis Ax of the drum 124, and a line connecting the center of the second drive module 330*b* and the rotation axis Ax of the drum 124, and the third center angle means the angle between a line connecting the center of the second drive module 330*b* and the rotation axis Ax of the drum 124, and a line connecting the center of the first drive module 330*a* and the rotation axis Ax of the drum 124.

Here, the same does not mean the exact same in a mathematical sense, but means that the approximation is the same within a range including an error. The first center angle, the second center angle, and the third center angle may be 119 degrees to 121 degrees.

The gear rail 350 is gear-coupled and rotated with each drive module 330. The gear rail 350 may have a ring shape having a diameter smaller than that of the guide part 341*a*.

For example, the gear rail 350 may include a ring-shaped rail body 351*a*, a rack gear 351*b* formed in an inner circumferential surface of the rail body 351*a*, and a protrusion 351*c* that is protruded from the outer circumferential surface of the rail body 351*a* and restrains the balancing weight 360.

The rack gear 351*b* is formed along the inner circumferential surface of the rail body 351*a*. The inner circumferential surface of the rail body 351*a* means a surface relatively close to the rotation axis Ax of the drum 124 in the rail body 351*a*, and the outer circumferential surface of the rail body 351*a* means a surface positioned farther from the rotation axis (Ax) of the drum 124 than the outer circumferential surface of the rail body 351*a* in the rail body 351*a*. The inner circumferential surface of the rail body 351*a* and the outer circumferential surface of the rail body 351*a* may be disposed to face each other. The inner circumferential surface of the rail body 351*a* and the outer circumferential surface of the rail body 351*a* are disposed to surround the rotation axis Ax of the drum 124.

The gear rail 350 may be provided to correspond to the number of drive modules 330. The gear rail 350 includes a first gear rail 351 and a second gear rail 352. The first gear rail 351 is rotated by the driving force of the first drive module 330*a*, and the second gear rail 352 is rotated by the driving force of the second drive module 330*b*. The rack gear 351*b* of the first gear rail 351 is engaged with the pinion gear 332 of the first drive module 330*a*, and the rack gear 351*b* of the second gear rail 352 is engaged with the pinion gear 332 of the second drive module 330*b*.

The gear rail 350 may be accommodated in the rail accommodating part 341*d*. The gear rail 350 may rotate while sliding in the rail accommodating part 341*d*.

The two gear rails 350 may be positioned at different heights. The first gear rail 351 and the second gear rail 352 may be disposed to be overlapped in the direction of the central axis of the drum 124. In FIG. 4, the first gear rail 351 is disposed above the second gear rail 352.

The balancing weight 360 moves along the circumference of the drum 124 by the driving force of the drive module 330. In detail, the balancing weight 360 moves along the circumference of the drum 124 by the rotation of each gear rail 350 to change the center of gravity of the drum 124. At least two balancing weights 360 are provided, and each balancing weight 360 is restrained by each gear rail 350. The balancing weight 360 may include a first balancing weight 360 and a second balancing weight 360.

The balancing weight 360 may include a balancing body 361 having a coupling groove 361*a* coupled to the gear rail 350, and a roller 362 coupled to the balancing body 361.

The balancing body 361 may include an object having a weight or mass. The balancing body 361 has an arc shape, and a coupling groove 361*a* may be formed in a surface facing the outer circumferential surface of the gear rail 350. The protrusion 351*c* of the gear rail 350 is inserted into the coupling groove 361*a*. The protrusion 351*c* is inserted into the coupling groove 361*a* of the balancing body 361, so that the movement of the balancing body is restrained by the rotation of the gear rail 350.

The roller 362 is provided in the balancing body 361 so as to be rotatable. The roller 362 is in close contact with the inner surface of the guide part 341*a* and is rolled. The roller 362 prevents the balancing body 361 from directly touching the inner surface of the guide part 341*a*. It is preferable that a plurality of rollers 362 are provided in both ends of the balancing body 361.

It is preferable each drive module 330 is positioned inside an arbitrary circumference formed by the gear rail 350, and each balancing weight 360 is positioned outside of an arbitrary circumference formed by the gear rail 350 in terms of utilization of space.

Hereinafter, referring to FIGS. 5A to 5C, the positional relationship between the coil base 343, the reception coil 310, and each component will be described in detail.

Since the reception coil 310 should be wired to the circuit board 370, it should be disposed close to the circuit board 370. In addition, the reception coil 310 should be positioned to avoid interference with the balancing weight 360 moving along the circumference. The reception coil 310 should be stably fixed when the guide case 340 is heat-welded. Accordingly, the coil base 343 is used so that the reception coil 310 is stably positioned to be close to the circuit board 370 and not to be interfered by the balancing weight 360.

The coil base 343 is accommodated in the guide case 340 and supports the reception coil 310. In detail, the coil base 343 is disposed at a different height from the balancing weight 360, such that the reception coil 310 supported on the coil base 343 is disposed at a different height from the balancing weight 360. In detail, the coil base 343 may be disposed at a height higher than the balancing weight 360, and the reception coil 310 may be disposed above the coil base 343.

Accordingly, since the balancing weight 360 and the reception coil 310 are positioned at different heights by the coil base 343, interference between the balancing weight 360 and the reception coil 310 can be avoided. Here, the height reference is an up and down direction in FIG. 5C. A higher one is positioned in a relatively upward direction, and a low one is positioned in a relatively downward direction.

When the circuit board 370 is disposed at a different height from the balancing weight 360, the thickness of the balancer becomes too thick. Accordingly, preferably, the circuit board 370 and the balancing weight 360 are disposed at the same height. Since the reception coil 310 should be positioned close to the circuit board 370, at least a part of the reception coil 310 overlaps with the circuit board 370 in the upper portion of the circuit board 370 of the reception coil 310.

The coil base 343 may be disposed at a different height from the circuit board 370. In detail, the coil base 343 may be positioned in the upper portion of the circuit board 370, and the reception coil 310 may be disposed in the upper portion of the coil base 343. Therefore, the thickness of the balancer can be reduced while adjoining the circuit board 370 and the reception coil 310.

The reception coil 310 may be disposed at a different height from the drive module 330. The reception coil 310 may be disposed at a height higher than that of the drive module 330. The drive module 330 may be positioned at the same height as the circuit board 370 or the balancing weight 360.

More specifically, the coil base 343 may be positioned above the receiver accommodating part 341*f* and the guide part 341*a*. That is, the coil base 343 may be supported by the upper end of the case body 341 while covering at least a portion of the guide part 341*a* and a portion of the receiver accommodating part 341*f*. Preferably, the coil base 343 may be supported by the support part 341*g* of the case body 341.

The coil base 343 may be configured to prevent the inflow of slag into the receiver accommodating part 341*f* and the guide part 341*a*, be fixed to the guide case 340 before heat-welding, and support the reception coil 310.

For example, it may include a base plate 31, an alignment protrusion 32, an overflow preventing surfaces 33, 34, and a fixing protrusion 35. The base plate 31 supports the reception coil 310. The base plate 31 may have a larger area than at least the reception coil 310.

The overflow preventing surface 33, 34 may be extended in a direction intersecting the extension direction of the base plate 31 from both ends of the base plate 31. Referring to FIG. 5C, the base plate 31 is extended in the horizontal direction, and the overflow preventing surface 33, 34 may be extended in the up and down direction from the inner and outer ends of the base plate 31. Here, the inner end is an end closer to the rotation axis Ax of the drum than the outer end.

The overflow preventing surface 33, 34 is supported by the support part 341*g*, so that the base plate 31 is positioned above the receiver accommodating part 341*f* and the guide part 341*a*. In addition, the overflow preventing surface 33, 34 may define a gap 21 in which slag is collected between the guide case 340 and the overflow preventing surface 33. That is, the gap 21 is a separation space formed between one surface of the coil base 343 and at least three surfaces of the guide case 340, and prevents the slag, which is generated when the case body 341 and the case cover 342 are heat-welded, from flowing into the guide part 341*a* and the receiver accommodating part 341*f*.

The width of the overflow preventing surface 33, 34 is formed smaller than the width of the support part 341*g*, and the gap 21 is positioned farther from the base plate 31 than the overflow preventing surface 33, 34. The gap 21 may be positioned in the flange 3415. By the overflow preventing surface 33, 34, the slag which disturbs the movement of the balancing weight 360 does not flow into the guide part 341*a*.

The fixing protrusion 35 protrudes from the base plate 31 to determine the position of the base plate 31. In detail, the fixing protrusion 35 protrudes downward from the lower end of the overflow preventing surface 33, 34 to be coupled to the alignment groove of the case body 341. The fixing protrusion 35 protrudes in the opposite direction to the alignment protrusion 32.

The alignment protrusion 32 protrudes upward from the base plate to determine the position of the reception coil 310. Two alignment protrusions 32 may be disposed spaced apart from each other, and the reception coil 310 may be disposed to surround the alignment protrusions 32.

The melting point of the coil base 343 may be the same as the guide case 340 or higher than the guide case 340. Preferably, the melting point of the coil base 343 may be higher than the guide case 340. This is because if the melting point of the coil base 343 is higher than the guide case 340, the coil base 343 does not melt during heat-welding of the guide case 340, and the inflow of slag can be effectively prevented.

The noise and vibration of the washing machine may occur when the drum is rotated, particularly, in a dehydration process where the drum is rotated at high speed. Hereinafter, the driving of the drum in the dehydration process will be described.

Figure 9:
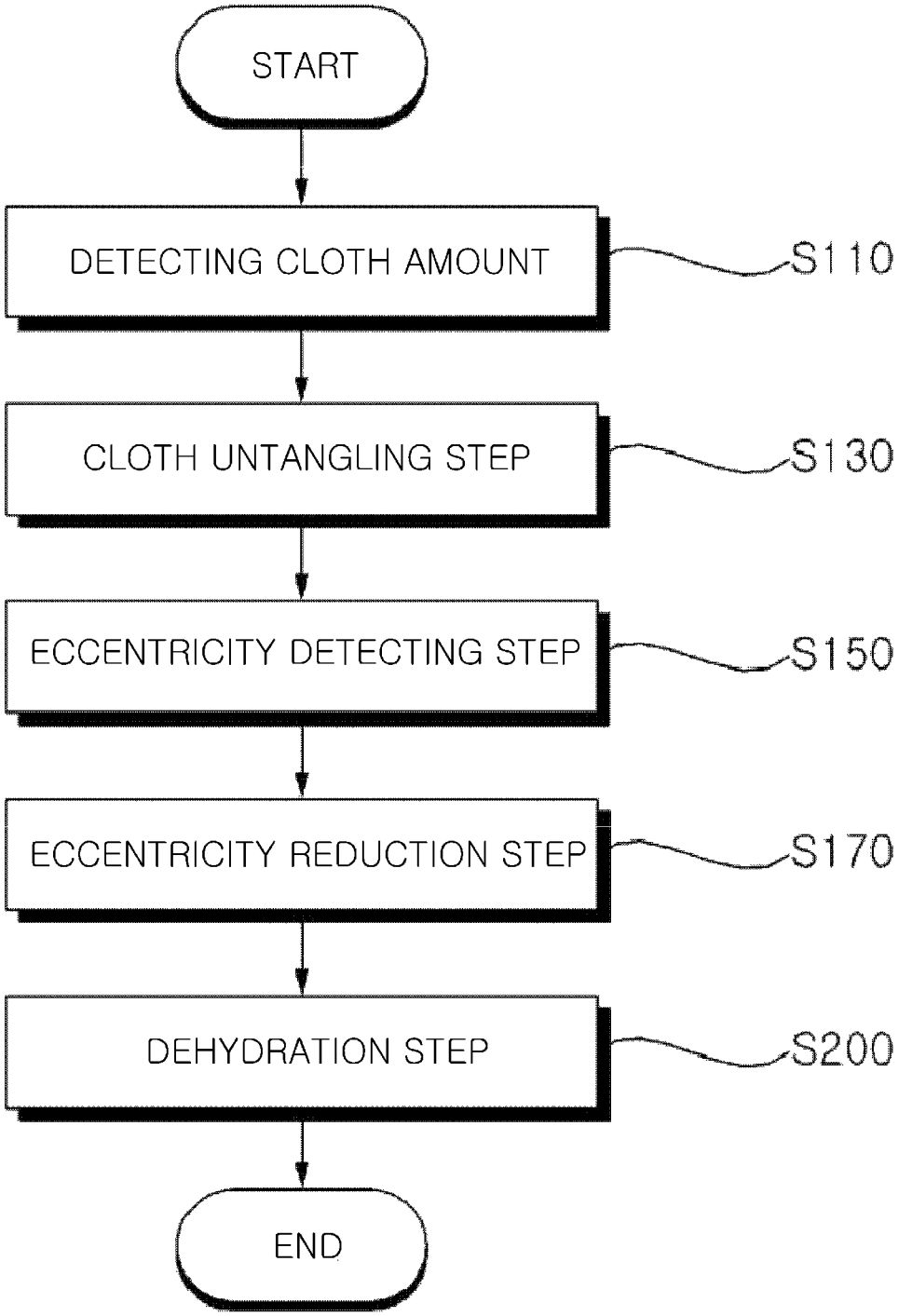
FIG. 9 is a flowchart illustrating a dehydration process according to an embodiment of the present invention.
Figure 10:
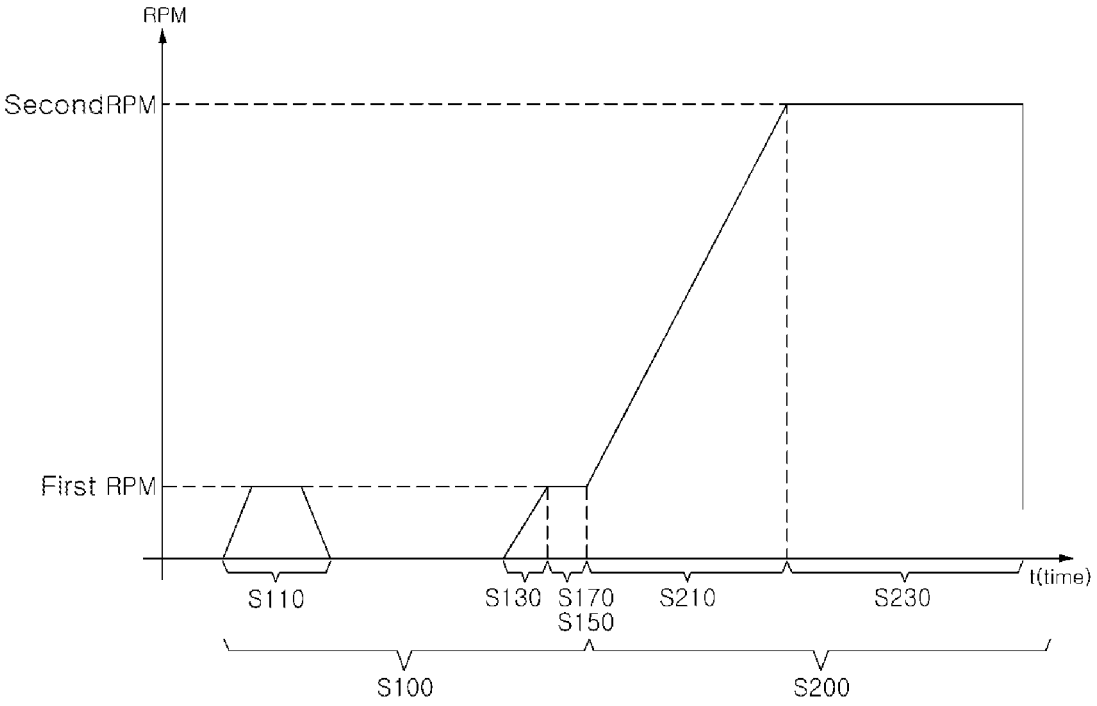
FIG. 10 is a graph showing the rotational speed of a drum in the dehydration process of FIG. 9.

FIG. 9 is a flowchart illustrating a dehydration process according to an embodiment of the present invention, and FIG. 10 is a graph showing the rotational speed of a drum in the dehydration process of FIG. 9.

In the graph of FIG. 10, the horizontal axis indicates time, and the vertical axis indicates the rotational speed of the drum 30, i.e., the change of RPM.

Referring to FIGS. 9 and 10, the dehydration process may briefly include a cloth dispersion step S100 and a dehydration step S200.

In the cloth dispersion step S100, the drum 124 may be rotated at a relatively low speed to evenly disperse the cloth. In the dehydration step S200, the drum 124 may be rotated at a relatively high speed to remove moisture of the laundry. However, the cloth dispersion step and the dehydration step are named based on their main function, and the function in each step is not limited depending on the name. For example, in the cloth dispersion step, water may be removed from the cloth by the rotation of the drum 124, in addition to the cloth dispersion. Hereinafter, each step will be described in detail.

Obviously, the cloth dispersion step S100 may include a step of detecting the eccentricity of the drum 124 and releasing the eccentricity of the drum 124 by the balancer.

When a rinsing process is finished, the cloth inside the drum 124 is wet by moisture. When starting the dehydration process, a controller 260 may first detect the cloth amount inside the drum 124, i.e., the amount of wet cloth (S110).

The reason for detecting the amount of wet cloth is that the weight of the water-containing cloth is different from the weight of the dry cloth even if the amount of non-wet amount, i.e., the amount of dry cloth, is detected at the initial stage of the washing process. The detected amount of wet cloth serves as a factor that determines a permission condition for accelerating the drum 124 in a transient area passing step S210 described later, or determines to perform the cloth dispersion step again by decelerating the drum 124 by the eccentric condition in the transient area passing step S210.

In detail, the amount of wet cloth inside the drum 124 may be measured when the drum 124 is accelerated to a first rotational speed (a first RPM), e.g., about 100 to 110 RPM to drive at a constant speed for a certain time and is decelerated. Power generation braking may be used when the drum 124 is decelerated. The amount of wet cloth can be detected by using the amount of rotation in an acceleration section during acceleration of the drive motor 40 for rotating the drum 124, the amount of rotation in a deceleration section during deceleration, an applied motor DC power, and the like.

In the detection of the amount of wet cloth, in order to reduce the occurrence of error in the detection of the cloth amount by the balancer, the position of the balance weights 360 of the balancer is detected, and a plurality of balancing weights 360 have the same phase difference (phase difference between two balancing weights 360 is 180°. Detecting the position of the balancing weight 360 will be described later.

Meanwhile, after the detection of the amount of wet cloth, the controller 260 may perform a cloth untangling step for the cloth dispersion inside the drum 124 (S130). The cloth untangling step intends to evenly disperse the cloths inside the drum 124 so as to prevent the cloths from being concentrated in a specific area inside the drum 124 and increasing the amount of eccentricity of the drum 124. This is because noise and vibration increase when the RPM of the drum 124 is increased if the amount of eccentricity is increased.

In detail, the cloth untangling step may be performed until the drum 124 is accelerated in one direction by a certain inclination and reaches the rotation speed of an eccentric detection step described later.

Next, the controller 260 may detect an eccentricity of the drum 124 (S150). When the cloth inside the drum 124 is not evenly dispersed and concentrated in a certain area inside the drum 124, the amount of eccentricity is increased. Thus, when the RPM of the drum 124 is increased later, noise and vibration may be caused due to the eccentric rotation. Accordingly, the controller 260 may determine whether to accelerate the drum 124 by detecting the eccentric amount of the drum 124.

Eccentricity detection may be performed by using an acceleration difference when the drum 124 rotates. That is, depending on the degree of eccentricity, when the drum 124 rotates, there is a difference in acceleration between a case where the drum 124 rotates downward according to the gravity and a case where the drum 124 rotates upward in the opposite direction to the gravity. The controller 260 may measure the acceleration difference by using a speed sensor such as a hall sensor provided in the drive motor 40, and may detect an eccentric amount by the detected acceleration difference.

Therefore, in the case of detecting the eccentricity, even if the drum 124 rotates, the cloth inside the drum 124 should not fall and maintain the state of being attached to the inner wall of the drum 124, which corresponds to a case where the drum 124 rotates at a rotational speed of about 100 to 110 RPM.

When the detected amount of eccentricity of the drum 124 is greater than or equal to a reference eccentricity in a certain amount of wet cloth, if the drum 124 is accelerated at a high speed, the vibration and noise of the drum 124 are significantly increased, which makes it difficult to accelerate the drum 124. Therefore, the controller 260 may store the data, in the form of a table, in which a reference amount of eccentricity permitting acceleration is previously determined according to the amount of wet cloth. Therefore, it is possible to determine whether to accelerate by applying the detected amount of wet cloth and amount of eccentricity to the table.

That is, when the amount of eccentricity according to the detected amount of the wet cloth is equal to or greater than the reference amount of eccentricity, the eccentric amount is too large to accelerate the drum 124, so that an eccentric reduction step is executed.

In the eccentric reduction step, the amount of eccentricity may be reduced by repeating the above-described wet cloth detection step, the cloth untangling step, the eccentric detection step or by moving the position of the balancing weight 360.

In detail, the eccentricity reduction step by using the balancer may include a step of minimizing the phase difference between two or more balancing weights 360. That is, prior to moving the two or more balancing weights 360 to minimize the eccentricity, firstly, the phase difference between the balancing weights 360 may be minimized, for example, the balancing weights 360 may be connected to each other. This is because when two or more balance weights 360 are provided and, if they are moved individually, it is time-consuming and complicated to reduce the amount of eccentricity.

Meanwhile, in order to minimize the phase difference between two or more balancing weights 360, that is, to connect with each other, the position of the balancing weight 360 may be determined based on the amount of change in the input current value of the transmission coil 240.

Therefore, in the case where the phase difference between the balancing weights 360 is to be minimized (or connected to each other), the controller 260 may move the balancing weights 360 in opposite directions, and when the distance between the balancing weights 360 is minimized, the movement of the balancing weight 360 may be stopped to minimize the phase difference.

Next, the eccentric amount of the drum 124 is detected while moving the two or more balancing weights 360 to be relatively moved with respect to the drum 124. That is, when the drum 124 rotates at a certain rpm, for example, a rpm (a case where the drum 124 rotates at a rotational speed of about 100 to 110 RPM) at which the cloth inside the drum 124 does not fall and is attached to the inner wall of the drum 124, the balancing weight 360 moves relatively with respect to the drum 124 and moves along the inside of the housing. In this case, the amount of eccentricity of the drum 124 may be reduced when the balancing weight 360 moves approximately to an eccentric corresponding position. Therefore, the controller 260 detects an eccentric amount of the drum 124 according to the movement of the balancing weight 360.

Next, the controller 260 may stop the movement of the balancing weight 360 at a first position where a first minimum value of the eccentricity of the drum 124 is detected. The controller 260 may store the minimum value as the first minimum value when the minimum value of the eccentricity is detected according to the movement of the balancing weight 360. In addition, the position of the balancing weight 360 in which the first minimum value is detected may be stored as the first position. Since the first minimum value corresponds to the minimum value of the eccentricity when the balancing weights 360 move in a minimum phase, i.e., in a connected state with each other, the controller 260 moves the balancing weight 360 to the first position to fix the position. Here, the first position may be changed according to various factors such as the dispersion of the cloth inside the washing machine, the cloth amount, the installation position of the balancer, and the like, and may correspond to an approximately eccentric corresponding position.

Meanwhile, in the case of having two or more balancing weights 360, the eccentricity of the drum 124 can be further reduced than the first minimum value. That is, since the first minimum value is a value detected when two or more balancing weights 360 have a minimum phase difference (or state of being connected with each other), each of the two or more balancing weights 360 is moved from the first position where the first minimum value is detected, the amount of eccentricity can be reduced to a value smaller than the first minimum value.

When the amount of eccentricity according to the detected wet amount is equal to or less than the reference amount of eccentricity, the acceleration permission condition is satisfied, so that the subsequent transient area passing step S210 may be performed.

Here, the transient area may be defined as a certain RPM band including one or more resonance frequencies in which resonance occurs according to a system of a washing machine. The transient area is an inherent vibration characteristic that occurs according to a determined system when the system of the washing machine is determined. The transient area is changed according to the system of the washing machine and, for example, may have a range of approximately 200 to 350 RPM.

That is, when the rotational speed of the drum 124 passes through the transient area, resonance occurs in the washing machine, and the noise and vibration of the washing machine may be significantly increased. In the washing machine, noise and vibration cause discomfort to the user, and further, disturb the acceleration of the drum 124. In the case of passing through the transient area, the acceleration slope may be adjusted appropriately to reduce the noise and vibration when accelerating the drum 124.

Meanwhile, as the drum 124 is accelerated while passing through the transient area, or due to an unexpected shock applied from the outside, the amount of eccentricity of the drum 124 may increase. When the amount of eccentricity of the drum 124 becomes larger than a certain value, the noise becomes remarkably larger, and it becomes difficult to continuously accelerate the drum 124. Therefore, when passing through the transient area, the controller 260 can continue to detect the amount of eccentricity of the drum 124.

In addition, the controller 260 may be provided with a vibration sensor in the drum 124 of the washing machine and may detect the vibration of the drum 124 when passing through the transient area. If the detected vibration and/or amount of eccentricity of the drum 124 in the transient area passing step becomes larger than a certain value, the controller 260 decelerates the drum 124 to repeat the above-described wet cloth detection step, the cloth untangling step, and the eccentric detection step, or to execute the eccentric detection step and the eccentricity reduction step S170 using the balancer described above.

Subsequent to the transient area passing step, the controller 260 may perform a water extraction step (S230).

The controller 260 removes water from a washing object by maintaining the rotational speed of the drum 124 at a second RPM (S200). In detail, in the water extraction step, the drum 124 is accelerated to a relatively high speed up to a desired RPM and maintained to extract the water.

In the related art, since a plurality of position detection sensors (usually, ten or more sensors are disposed for accurate position detection) are used along the circumference of the drum 124, manufacturing cost is greatly increased, and it is difficult to measure the exact position.

Hereinafter, a washing machine and a control method of the same for measuring the position of the balancing weight 360 which solves the conventional problem will be described in detail. In the eccentric reduction and cloth amount detection steps using the above-described balancer, a method of measuring the position (phase) of the balancing weight 360 of the present invention is used.

Figure 11A:
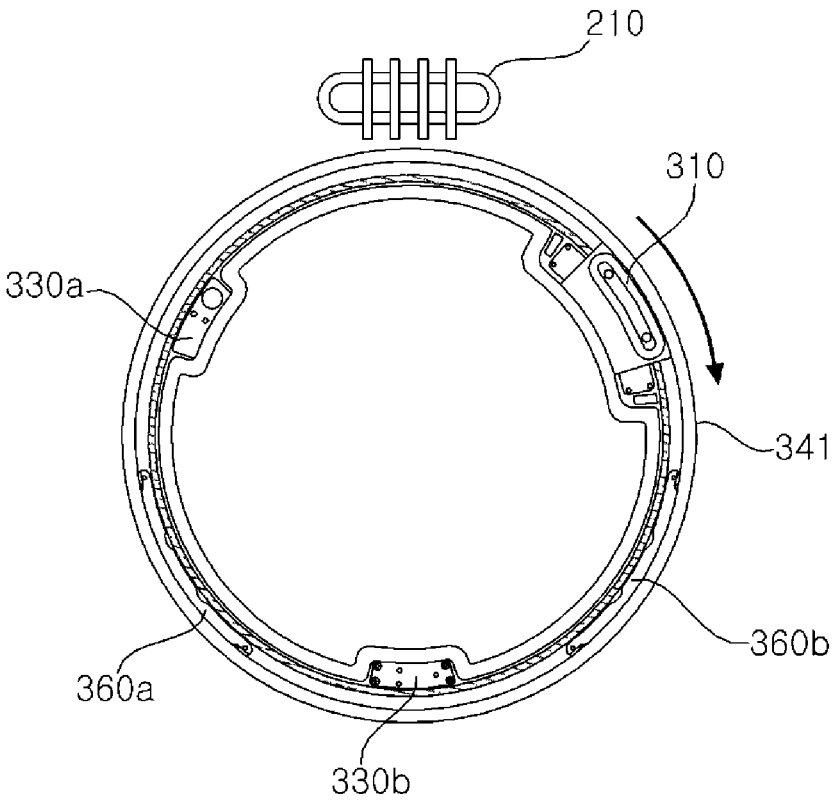
FIGS. 11A to 11D shows each part of a balancer relatively moving with respect to a transmission coil when the drum rotates.
Figure 11B:
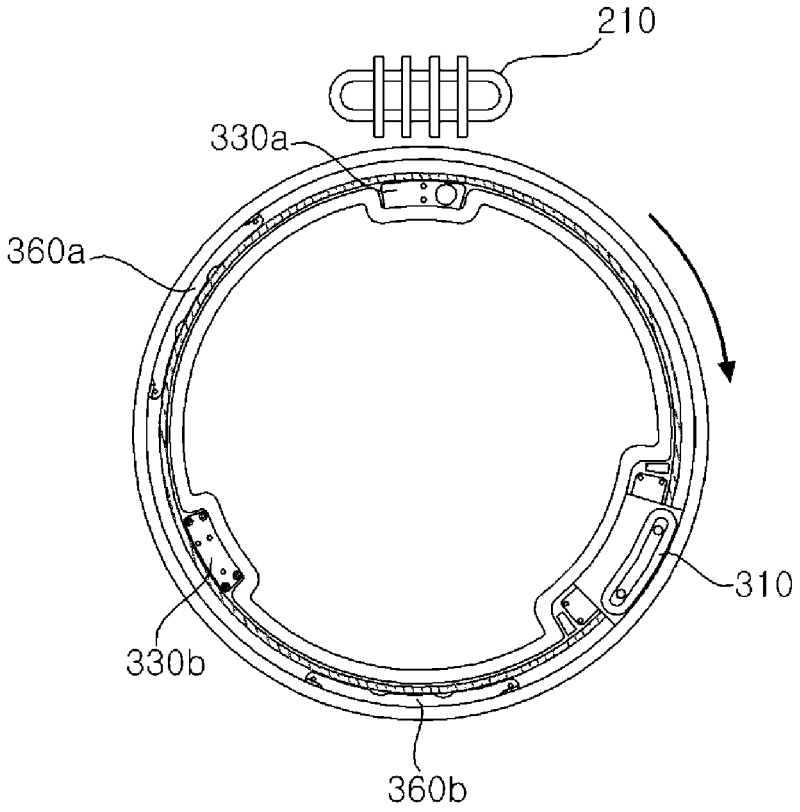
Figure 11C:
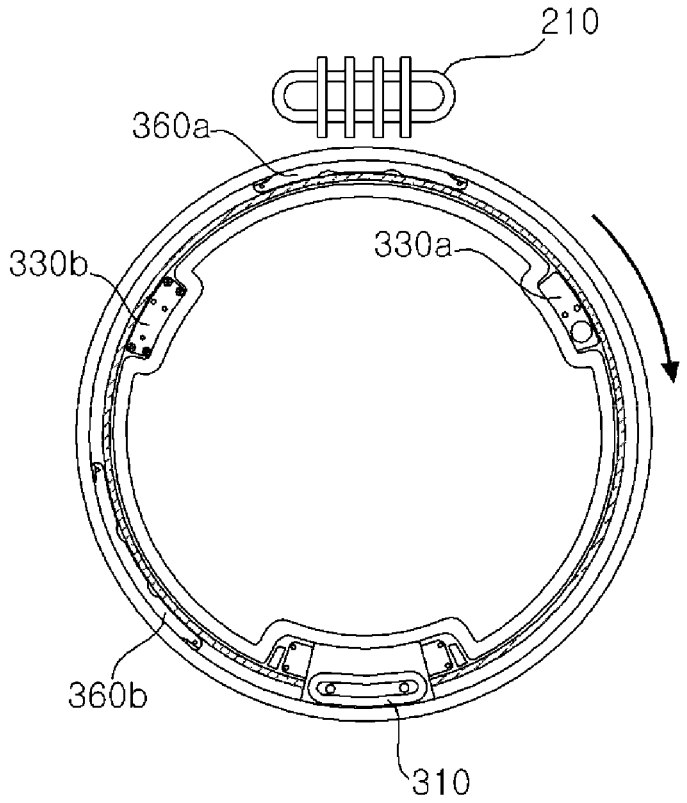
Figure 11D:
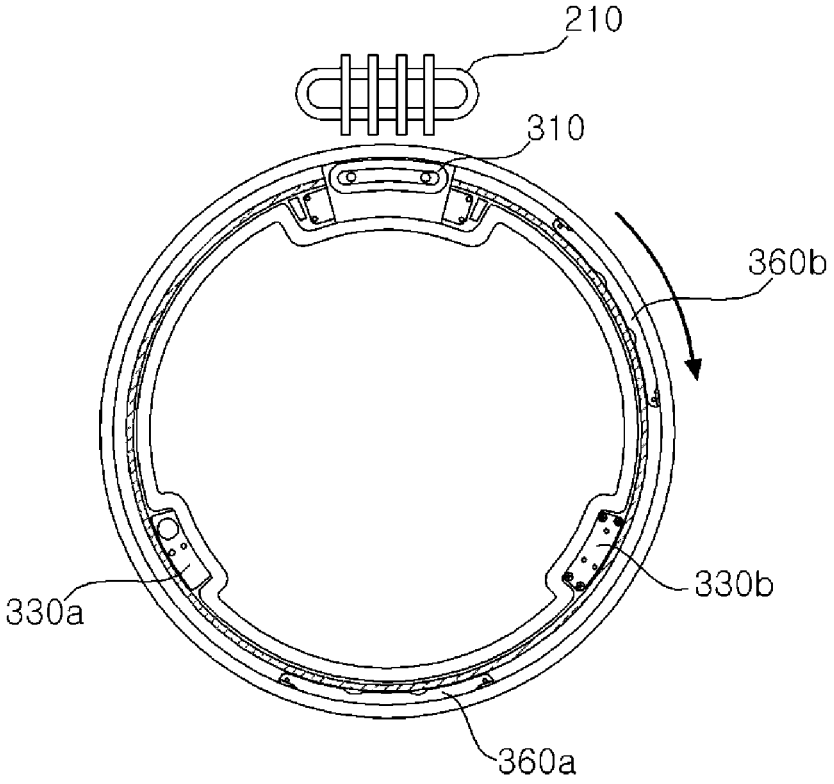
Figure 12A:
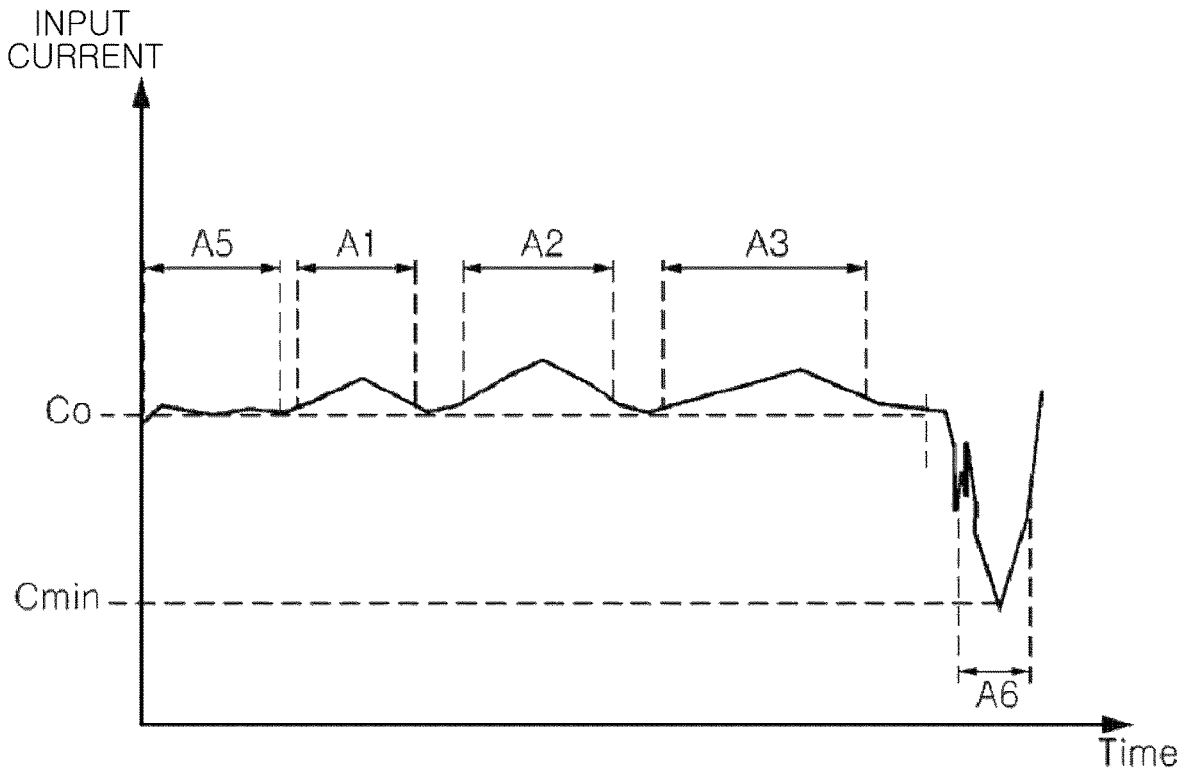
FIG. 12A is a graph illustrating a change in an input current value of a transmission coil over time according to an embodiment of the present invention.
Figure 12B:
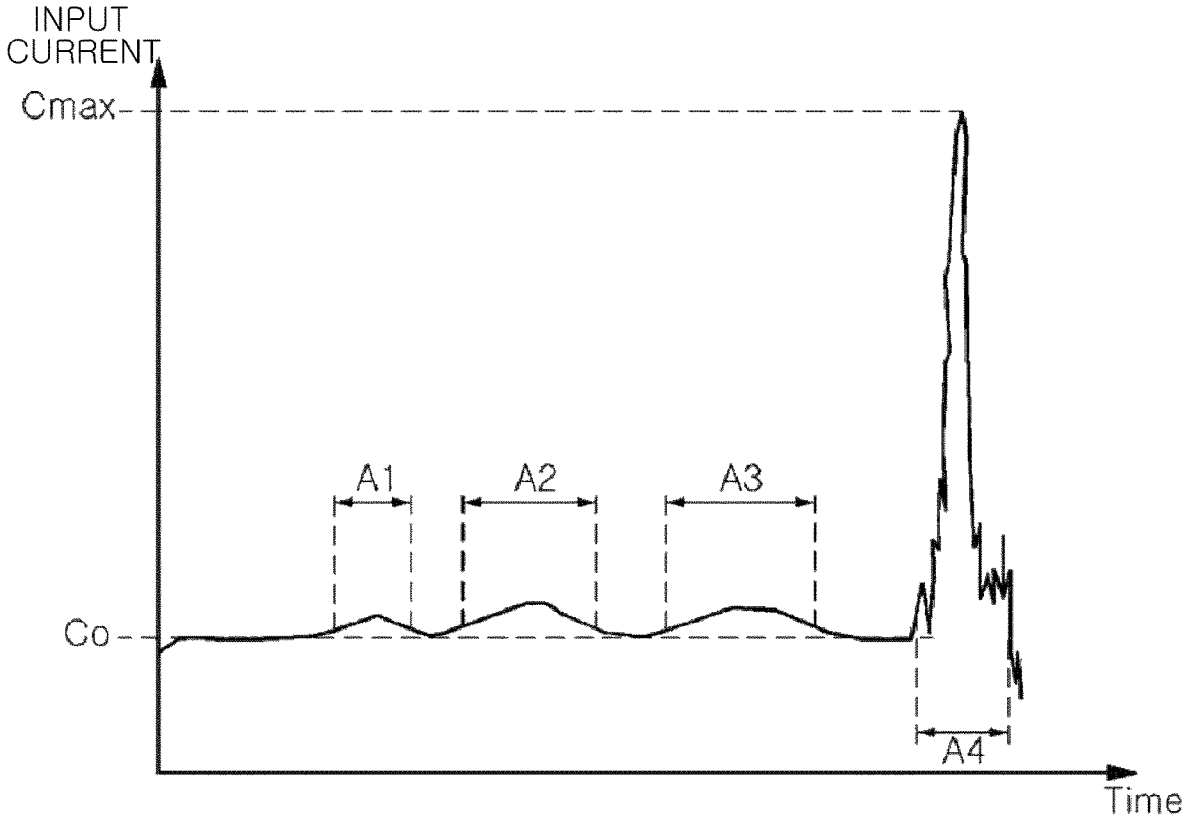
FIG. 12B is a graph illustrating a change in an input current value of a transmission coil over time according to another embodiment of the present invention.

FIGS. 11A to 11D shows each part of a balancer relatively moving with respect to a transmission coil 240 when the drum 124 rotates, FIG. 12A is a graph illustrating a change in an input current value of a transmission coil over time according to an embodiment of the present invention, and FIG. 12B is a graph illustrating a change in an input current value of a transmission coil over time according to another embodiment of the present invention.

In particular, FIG. 12A is a graph illustrating a change in an input current value of a transmission coil for each unit time according to one rotation of the drum 124 when the drive motor 300 of the drive module 330 is turned off. FIG. 12B is a graph illustrating a change in the input current value of the transmission coil for each unit time according to one rotation of the drum 124 when the drive motor 300 of the drive module 330 is turned on.

When the drum 124 is rotated while power is applied to the transmission coil 240, the input current value of the transmission coil 240 is changed. When the transmission coil 240 is adjacent to (or overlapped with) the reception coil 310, the input current value of the transmission coil 240 is changed rapidly because power is transmitted to the reception coil 310, and when the transmission coil 240 is adjacent to other member, the change of the input current value of the transmission coil 240 becomes small.

Here, 'the transmission coil 240 is adjacent to a certain configuration' means that the transmission coil 240 is vertically overlapped with a certain configuration in the direction of the rotation axis of the drum 124 and is very close to each other. In this case, other configurations are spaced apart from the transmission coil 240 without being vertically overlapped with the transmission coil 240.

In detail, as shown in FIG. 11A, when the transmission coil 240 is adjacent to other configuration (guide case 340) excluding the balancing weight 360, the drive module 330, and the reception coil 310, the input current value of the transmission coil 240 becomes a reference current value C0. Here, the reference current value C0 may be a value preset by an experiment, or may be an average current value of a section A5 having a rate of change of a certain time or less in an input current value curve. At this time, the guide case 340 is preferably formed of a resin material so as to change the input current value of the transmission coil 240 a little.

As shown in FIG. 11B, when the drum 124 is rotated in the clockwise direction and the transmission coil 240 is adjacent to the drive module 330, the input current value of the transmission coil 240 has a larger value than the reference current value C0, and has a value smaller than a maximum current value (Cmax). Since the drive module 330 has a material including magnetism, it changes the input current value of the transmission coil 240.

As shown in FIG. 11C, when the drum 124 is rotated in the clockwise direction and the transmission coil 240 is adjacent to the balancing weight 360, the input current value of the transmission coil 240 has an intermediate current value that is larger than the reference current value C0 and smaller than the maximum current value (Cmax). Obviously, the intermediate current value may be a value larger than the input current value of the transmission coil 240 when the transmission coil 240 is adjacent to the drive module 330.

The balancing weight 360 may have a larger mass, a larger volume, and a larger length than the drive module 330. Since the balancing weight 360 has a larger mass and size than the drive module 330, it is easy to distinguish the balancing weight 360 from the drive module 330 on an input current curve. More preferably, the balancing weight 360 may contain a metal, or may contain a metal and a material including magnetism.

Referring to FIG. 11D, when the transmission coil 240 is adjacent to (or overlapped with) the reception coil 310 and the drive motor 300 is in an off state, the input current value of the transmission coil 240 is decreased than the reference current value C0 as shown in FIG. 12A. In general, the input current value of the transmission coil 240 has a minimum current value Cmin, when the transmission coil 240 is adjacent to (or overlapped with) the reception coil 310 and the drive motor 300 is in an off state.

When the transmission coil 240 and the reception coil 310 are adjacent to each other and then are far away, the rate of change of the input current value of the transmission coil 240 is maximized.

When the transmission coil 240 is adjacent to (or overlapped with) the reception coil 310 and the drive motor 300 is in an on state, the input current value of the transmission coil 240 is increased larger than the reference current value C0 as shown in FIG. 12B. In general, the input current value of the transmission coil 240 has a maximum current value Cmax when the transmission coil 240 is adjacent to (or overlapped with) the reception coil 310 and the drive motor 300 is in an on state.

As described above, when each configuration of the balancer is adjacent to the transmission coil 240, a change in the input current value of the transmission coil 240 occurs, so that the position of the configuration fixed to the drum 124 may be determined based on the input current value of the transmission coil 240, and the position of the balancing weight 360 may be determined as a relative phase difference in the configuration fixed to the drum 124. Hereinafter, it is illustrated that the relative position of the balancing weights 360 is determined based on the reception coil 310. However, it is not limited thereto, and the position of the balancing weight 360 may be calculated based on the drive module 330.

The controller 260 determines the position of the balancing weight 360 based on the input current value when the drum 124 rotates, while power is supplied to the transmission coil 240. The controller 260 may vary the method of determining the position of the balancing weight 360 according to the on or off state of the drive motor 300.

First, a method of determining the position of the balancing weight 360 according to the off state of the drive motor 300 will be described.

For example, the controller 260 controls an ammeter to measure the input current value for each unit time during at least one rotation of the drum 124, and may determine a first time point at which the input current value becomes less than or equal to a preset first current value as the position of the reception coil. The first current value may be 0.5 times to 0.7 times the reference current value C0.

At this time, since the drum 124 is rotated at a constant speed, when the time from the rotation time point of the drum 124 to the first time point is measured, the phase difference between the initial position of the drum 124 and the reception coil may be obtained according to the ratio with respect to the time when the drum 124 is rotated once. Obviously, the first time point may be set as a reference time point and, at this time, the position of the reception coil 310 may be defined as a reference position (0°). Here, the first current value may be set smaller than the reference current value.

Obviously, in order to accurately calculate the first time point, the intermediate time point of a section A6 in which the input current value becomes less than or equal to a preset first current value may be defined as the first time point.

Thereafter, the controller 260 determines a second time point at which the input current value is equal to or greater than a preset second current value, and may determine a phase difference between the reception coil and the balancing weight 360 based on a time difference between the first time point and the second time point. The second current value may be 1.1 times to 1.2 times the reference current value C0. Here, the second current value may be set to a value larger than the input current value when the drive module 330 is adjacent to the transmission coil 240. Obviously, in order to accurately calculate the second time point, an intermediate time point of sections A2 and A3 in which the input current value becomes greater than or equal to the second current value may be defined as the second time points.

The operation of determining the phase difference between the reception coil and the balancing weight 360 based on the time difference between the first time point and the second time point may be calculated by multiplying a value obtained by dividing the time difference between the first time point and the second time point by one rotation time of the drum 124 by 360°. Accordingly, the relative position of the first balancing weight 360 and the second balancing weight 360 can be accurately calculated.

As another example, in the power-off state of the drive motor 300, the controller 260 may calculate an input current curve showing a change in the input current value over time during at least one rotation of the drum 124, and may determine the minimum point (C min) (within one period) of the input current value on the input current curve as the position of the reception coil.

The controller 260 selects a band section in which the input current value becomes greater than or equal to the preset reference current value C0. The controller 260 may distinguish the balancing weight 360 from the drive module 330 by a width (time) of the band section on the input current curve. In detail, the controller 260 determines the band section A2, A3 as the position of the balancing weight 360 when the width of the band section is larger than a preset width, and determines the band section A1 as the position of the drive module 330 when the width of the band section is smaller than the preset width.

The controller 260 may determine a phase difference between the reception coil and the balancing weight 360 based on a distance difference (in time axis) (or time difference) between the minimum point (Cmin) of the input current value and the peak of the band section A2, A3. The calculation of the phase difference based on the time difference or the distance difference is the same as described above.

Hereinafter, a method of determining the position of the balancing weight 360 according to the on state of the drive motor 300 will be described.

For example, the controller 260 controls the ammeter to measure the input current value for each unit time during at least one rotation of the drum 124, and may determine a third time point at which the input current value is greater than or equal to a preset third current value as the position of the reception coil. The third current value may be 1.3 times to 1.5 times the reference current value C0. At this time, the drum 124 is rotated at a constant speed. Here, the third current value may be set larger than the reference current value.

Obviously, in order to accurately calculate the third time point, the intermediate time point of a section A4 in which the input current value becomes greater than or equal to the preset third current value may be defined as the third time point.

Thereafter, the controller 260 determines a second time point at which the input current value is greater than or equal to the preset second current value and is less than or equal to the third current value, and may determine a phase difference between the reception coil and the balancing weight 360 based on the time difference between the third time point and the second time point.

Here, the second current value may be set to a value larger than the input current value when the drive module 330 is adjacent to the transmission coil 240. The second current value is set to a value smaller than the third current value. Obviously, in order to accurately calculate the second time point, an intermediate time point of the section A2, A3 in which an input current value is greater than or equal to the second current value and less than or equal to the third current value may be defined as the second time points.

The operation of determining the phase difference between the reception coil and the balancing weight 360 based on the time difference between the first time point and the second time point may be calculated by multiplying a value obtained by dividing the time difference between the first time point and the second time point by one rotation time of the drum 124 by 360°.

As another example, in the power-on state of the drive motor 300, the controller 260 may calculate an input current curve showing a change in the input current value over time during at least one rotation of the drum 124, and may determine the maximum point (C max) (within one period) of the input current value on the input current curve as the position of the reception coil.

The controller 260 selects a band section in which the input current value is greater than or equal to the preset reference current value C0 and smaller than the second current value. The controller 260 may distinguish the balancing weight 360 from the drive module 330 by a width (time) of the band section on the input current curve. In detail, the controller 260 determines the band section A2, A3 as the position of the balancing weight 360 when the width of the band section is larger than a preset width, and determines the band section A1 as the position of the drive module 330 when the width of the band section is smaller than the preset width.

The controller 260 may determine a phase difference between the reception coil and the balancing weight 360 based on a distance difference (in time axis) (or time difference) between the maximum point (Cmax) of the input current value and the peaks of the band section A2, A3.

When the controller 260 specifies the position of the balancing weight 360 by the input current value of the transmission coil 240, it is not necessary to mount a plurality of sensors to specify the position of the balancing weight 360, but the burden on the controller 260 can be reduced by a simple operation.

Hereinafter, the control method of the balancer and the washing machine described above will be described in detail.

Figure 13:
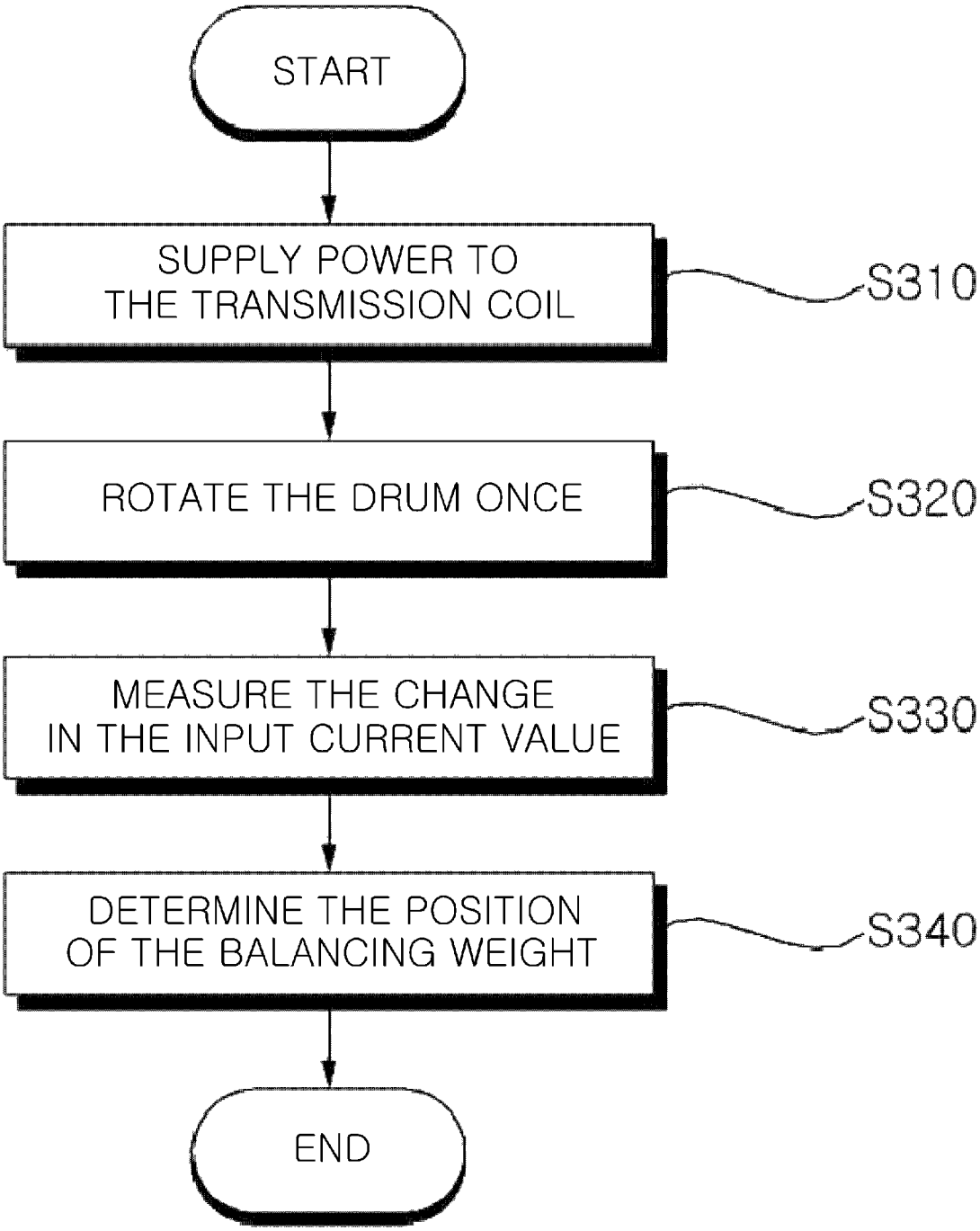
FIG. 13 is a flowchart illustrating a control method according to an embodiment of the present invention.

FIG. 13 is a flowchart illustrating a control method according to an embodiment of the present invention.

Referring to FIG. 13, the control method of the washing machine for determining the position of the balancing weight 360 of the present invention may include a step (a) of supplying power to the transmission coil 240 (S310), a step (b) of rotating the drum 124 at least once (S320), a step (c) of measuring the change in the input current value of the transmission coil 240 for each unit time during one rotation of the drum 124 (S330), and a step (d) of determining the position of the balancing weight 360 based on the change in the input current value (S340).

The control method of the washing machine for determining the position of the balancing weight 360 of the present invention can be accomplished at any step of the washing process described above.

First, the controller 260 controls the power supply unit 210 to supply power to the transmission coil 240 (S310).

Next, the controller 260 controls the drum motor 113 in a state in which power is supplied to the transmission coil 240 to rotate the drum 124 at least once (S320).

Next, the controller 260 controls the ammeter to measure the change in the input current value of the transmission coil 240 for each unit time during one rotation of the drum 124 (S330).

Next, the controller 260 determines the position of the balancing weight 360 based on the change in the input current value (S340).

For example, in step (d), the controller 260 may determine the minimum point (C min) (within one period) of the input current value as the position of the reception coil. More specifically, the controller 260 calculates an input current curve showing a change in the input current value over time during at least one rotation of the drum 124, and may determine the minimum point (C min) (within one period) of the input current value, on the input current curve, as the position of the reception coil.

In step (d), a band section in which the input current value becomes equal to or greater than the preset reference current value C0 is selected. The controller 260 may distinguish the balancing weight 360 from the drive module 330 by the width (time) of the band section on the input current curve. In detail, when the width of the band section is greater than the preset width, the controller 260 determines the band section A2, A3 as the position of the balancing weight 360. Then, the controller 260 may determine a phase difference between the reception coil and the balancing weight 360 based on the distance difference (in time axis) (or time difference) between the minimum point (Cmin) of the input current value and the peak of the band section A2, A3.

As another example, in step (d), the controller 260 may determine the maximum point (C max) (within one period) of the input current value as the position of the reception coil. In detail, the controller 260 may calculate an input current curve showing a change in the input current value over time during at least one rotation of the drum 124, and may determine the maximum point (C max) (within one period) of the input current value on the input current curve as the position of the reception coil. Then, the controller 260 selects a band section in which the input current value is greater than or equal to the preset reference current value C0 and smaller than the second current value. The controller 260 may distinguish the balancing weight 360 from the drive module 330 by a width (time) of the band section on the input current curve. In detail, the controller 260 determines the band section A2, A3 as the position of the balancing weight 360 when the width of the band section is larger than a preset width. Then, the controller 260 may determine a phase difference between the reception coil and the balancing weight 360 based on a distance difference (in time axis) (or time difference) between the maximum point (Cmax) of the input current value and the peaks of the band section A2, A3.

According to the balancer and the washing machine of the present invention, there are one or more of the following effects.

First, even if the balancer rotates with the drum, a wireless power transmitter can wirelessly transmit sufficient power to the balancer in a short time.

Second, since the balancing weight that actively moves, the drive module, and the reception coil are separated from each other, and the drive module and the balancing weight are not manufactured integrally, so that manufacturing is easy and manufacturing cost is reduced.

Third, the interference of the balancing weight moving along the circumference with the reception coil can be eliminated, and the circuit board is positioned close to the reception coil.

Fourth, the position of the balancing weight can be accurately measured only by the input current value of the transmission coil, without the need to add a plurality of sensors.

Fifth, since a single ammeter is added instead of a plurality of sensors, manufacturing cost is reduced.

Sixth, the reception coil is positioned to be higher than the circuit board and the balancing weight by using the coil base, and the slag generated during heat-welding of the guide case can be prevented from overflowing into the moving path of the balancing weight.

Seventh, since each drive module and the circuit board for controlling each drive module and supplying power are separated from each other and a single circuit board and a single reception coil are used, so that manufacturing cost is reduced, and the reliability is improved as the drive module does not move together with the balancing weight.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A washing machine comprising:

a tub configured to accommodate washing water;

a transmission coil that is provided in the tub and that is configured to transmit power wirelessly by generating a wireless power signal;

an ammeter configured to measure an input current value of the transmission coil;

a cylindrical drum that is disposed inside the tub to accommodate one or more objects and that is configured to rotate;

a balancer configured to reduce unbalance generated by a biasing of the one or more objects during rotation of the drum; and a controller configured to control the ammeter and the balancer, wherein the balancer comprises:

a reception coil that is provided in the drum and that is configured to generate power from a magnetic field formed by the transmission coil, at least two drive modules that are driven by the power of the reception coil and that are provided in the drum, and at least one balancing weight that is configured to move along a circumference of the drum by a driving force of each drive module and that is configured to change a center of gravity of the drum, and wherein the controller is configured to, based on the drum rotating, determine a position of the at least one balancing weight according to the input current value measured by the ammeter.

2. The washing machine of claim 1, wherein the controller controls the ammeter to measure an input current value for each unit time during at least one rotation of the drum, and determines a first time point at which the input current value is equal to or less than a preset first current value as a position of the reception coil.

3. The washing machine of claim 2, wherein the controller detects a second time point at which the input current value is equal to or greater than a preset second current value, and determines a phase difference between the reception coil and the balancing weight based on a time difference between the first time point and the second time point.

4. The washing machine of claim 1, wherein the controller controls the ammeter to measure the input current value for each unit time during at least one rotation of the drum, and determines a third time point at which the input current value becomes equal to or greater than a preset third current value as a position of the reception coil.

5. The washing machine of claim 4, wherein the controller detects a second time point at which the input current value is equal to or greater than a preset second current value and is less than or equal to the third current value, and determines a phase difference between the reception coil and the balancing weight based on a time difference between the third time point and the second time point.

6. The washing machine of claim 1, wherein the controller determines a minimum point of the input current value, on an input current curve showing a change in the input current value over time during at least one rotation of the drum, as a position of the reception coil, and determines a band section in which the input current value is equal to or greater than a preset reference current value as the position of the balancing weight.

7. The washing machine of claim 6, wherein the controller determines as a position of the drive module, based on a width of the band section being smaller than a preset width.

8. The washing machine of claim 6, wherein the controller determines a phase difference between the reception coil and the balancing weight based on a time difference between the minimum point of the input current value and a peak of the band section.

9. The washing machine of claim 1, wherein the controller determines a maximum point of the input current value, on an input current curve showing a change in the input current value over time during at least one rotation of the drum, as a position of the reception coil, and determines a band section in which the input current value becomes a value between a preset reference current value and a preset second current value, as a position of the balancing weight.

10. The washing machine of claim 9, wherein the controller determines as a position of the drive module, based on a width of the band section being smaller than a preset width.

11. The washing machine of claim 9, wherein the controller determines a phase difference between the reception coil and the balancing weight based on a time difference between the maximum point of the input current value and a peak of the band section.

12. A washing machine comprising:

a transmission coil that is configured to generate a wireless power signal and that is configured to transmit power wirelessly;

an ammeter configured to measure an input current value of the transmission coil;

a cylindrical drum that is configured to accommodate one or more objects and that is configured to rotate;

a balancer that comprises at least one balance weight and that is configured to, based on the drum rotating, reduce an unbalance generated by a biasing of the one or more objects; and a controller configured to control the ammeter and the balancer, wherein the controller is configured to, based on the drum rotating, determine a position of the balancing weights according to the input current value measured by the ammeter, wherein the balancer comprises:

a reception coil that is provided in the drum and that is configured to generate power from a magnetic field formed by the transmission coil, and at least two drive modules that are driven by the power of the reception coil and that are provided in the drum, wherein the at least one balancing weight is configured to move along a circumference of the drum by a driving force of each drive module and change a center of gravity of the drum.

* * * * *